US011571903B2

(12) United States Patent
Kobayashi et al.

(10) Patent No.: US 11,571,903 B2
(45) Date of Patent: Feb. 7, 2023

(54) LIQUID DISCHARGE APPARATUS, HEAD UNIT AND MIST COLLECTOR

(71) Applicant: Brother Kogyo Kabushiki Kaisha, Nagoya (JP)

(72) Inventors: Akihiro Kobayashi, Yokkaichi (JP); Kengo Takeda, Tokai (JP); Takahiro Nishimoto, Ogaki (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/360,600

(22) Filed: Jun. 28, 2021

(65) Prior Publication Data

US 2022/0040986 A1 Feb. 10, 2022

(30) Foreign Application Priority Data

Aug. 5, 2020 (JP) ..... JP2020-132971
Aug. 5, 2020 (JP) ..... JP2020-132972

(51) Int. Cl.
*B41J 29/377* (2006.01)
*B41J 2/47* (2006.01)
*B41J 2/17* (2006.01)
*B41J 2/475* (2006.01)

(52) U.S. Cl.
CPC ..... *B41J 2/1714* (2013.01); *B41J 2/475* (2013.01); *B41J 29/377* (2013.01)

(58) Field of Classification Search
CPC ... B41J 2/1714; B41J 2/435; B41J 2/44; B41J 2/475; B41J 29/377
See application file for complete search history.

(56) References Cited

U.S. PATENT DOCUMENTS 5,774,141 A * 6/1998 Cooper ..... B41J 2/1714 347/93
8,690,290 B2 4/2014 Masuda
9,199,471 B2 12/2015 Shibata et al.
2011/0109693 A1 5/2011 Ohnishi
2013/0229458 A1 9/2013 Masuda
2014/0292920 A1 10/2014 Shibata et al.
2018/0056685 A1* 3/2018 Tsuchiya ..... B41J 2/1714
2019/0009567 A1* 1/2019 Miyakoshi ..... B41J 2/18
(Continued)

FOREIGN PATENT DOCUMENTS

JP 2005-186422 A 7/2005
JP 2005-271314 A 10/2005
(Continued)

*Primary Examiner* — Scott A Richmond
(74) *Attorney, Agent, or Firm* — Banner & Witcoff, Ltd.

(57) ABSTRACT

There is provided a liquid discharge apparatus including: a head, a fixing device and a mist collector configured to collect a mist of a liquid. The mist collector and the fixing device are arranged side by side in this order in a first direction. The mist collector is provided with an air channel having a suction port and an exhaust port. The air channel has: a first part and a second part connected to an other end of the first part. The exhaust port is opened, in the second part, toward any one of directions which are: a direction including a direction opposite to the first direction as a directional component thereof, a third direction orthogonal to the first direction and a second direction, and a direction opposite to the third direction.

20 Claims, 8 Drawing Sheets

(56) References Cited

U.S. PATENT DOCUMENTS

| | | | | |
|---|---|---|---|---|
| 2019/0240981 | A1* | 8/2019 | Tachibana | B41J 2/1714 |
| 2019/0263133 | A1* | 8/2019 | Hiruma | B41J 29/38 |

FOREIGN PATENT DOCUMENTS

| | | | |
|---|---|---|---|
| JP | 2005-297372 | A | 10/2005 |
| JP | 2008-062433 | A | 3/2008 |
| JP | 2010-058441 | A | 3/2010 |
| JP | 2010-137483 | A | 6/2010 |
| JP | 2011-143657 | A | 7/2011 |
| JP | 2013-180540 | A | 9/2013 |
| JP | 2014-184596 | A | 10/2014 |
| JP | 2014-188927 | A | 10/2014 |

* cited by examiner

LIQUID DISCHARGE APPARATUS, HEAD UNIT AND MIST COLLECTOR

CROSS REFERENCE TO RELATED APPLICATION

The present application claims priorities from Japanese Patent Applications No. 2020-132971, filed on Aug. 5, 2020 and No. 2020-132972, filed on Aug. 5, 2020, the disclosures of which are incorporated herein by reference in their entireties.

BACKGROUND

Field of the Invention

The present disclosure relates to a liquid discharge apparatus, a head unit and a mist collector.

Description of the Related Art

As an example of a liquid discharge apparatus, there is known an image forming apparatus. In a certain publicly known image forming apparatus, an ink-jet recording head, a mist catching part and an UV light irradiator are arranged to be side by side in this order. An ink is made to fly from the ink-jet recording head onto a recording medium, and the ink on the recording medium is irradiated with an UV light by the UV light irradiator, thereby curing the ink. Further, a mist of the flying ink is caught by the mist catching part.

Further, as an example of the liquid discharge apparatus, there is known an ink-jet recording apparatus. A certain publicly known ink-jet recording apparatus is provided with a recording head, and a mist collector which collects a mist of an ink discharged or ejected from the recording head; and the mist collector has a duct. The duct extends upward from a suction port provided on a lower part of the duct, and is bent in a horizontal direction at an upper part of the duct, and a fan and filter is arranged in this horizontal part of the duct.

SUMMARY

In the above-described image forming apparatus, the mist flows into the mist caching part from a location below the mist catching part, and flows out to a location above the mist catching part. Due to this, there is such a fear that any mist which is not caught by the mist catching part and flows out of the mist catching part might flow to a side of the UV light irradiator and might adhere to the UV light irradiator.

Further, in the above-described ink-jet recording apparatus, an air including the mist is sucked from the suction port into the inside of the duct by the fan, flows in the duct in the up direction, is bent in the horizontal direction, and passes the filter, whereby the mist is caught and collected. In a case that the air is bent from the up direction to the horizontal direction, a convection flowing to the opposite side to the bending direction is generated. By this convection, the mist flows to a side of an inner wall, of the duct, which faces the filter, and adheres to the inner wall. Due to this, there is such a fear that the adhered mist might aggregate, whereby the ink might flow down along the inner wall and might dirty a recording medium, etc.

In view of such a situation, an object of the present disclosure is to provide a liquid discharge apparatus and a head unit which are capable of lowering any adhesion of the mist to the UV light irradiating part. Further, another object of the present disclosure is to provide a liquid discharge apparatus and a mist collector which are capable of reducing a liquid flowing down from the mist collector.

According an aspect of the present disclosure, there is provided a liquid discharge apparatus including: a head including a discharge surface in which a nozzle for discharging a liquid toward a medium is opened; a fixing device configured to fix the liquid on the medium; and a mist collector configured to collect a mist of the liquid, the mist collector and the fixing device being arranged side by side in this order in a first direction parallel to the discharge surface. The mist collector includes an air channel including a suction port via which an air is sucked into the mist collector, and an exhaust port via which the air is exhausted from the mist collector. The air channel includes: a first part in which the suction port is arranged, which is located between the head and the fixing device in the first direction, which includes one end and the other end, which extends in a second direction orthogonal to the discharge surface and oriented from the one end toward the other end, and in which the one end is closer to the discharge surface than the other end in the second direction; and a second part connected to the other end of the first part. The exhaust port is opened, in the second part, toward any one of directions which are: a direction including a direction opposite to the first direction as a directional component thereof, a third direction orthogonal to both the first direction and the second direction, and a direction opposite to the third direction.

DESCRIPTION OF THE EMBODIMENTS

First Embodiment

Figure 1:
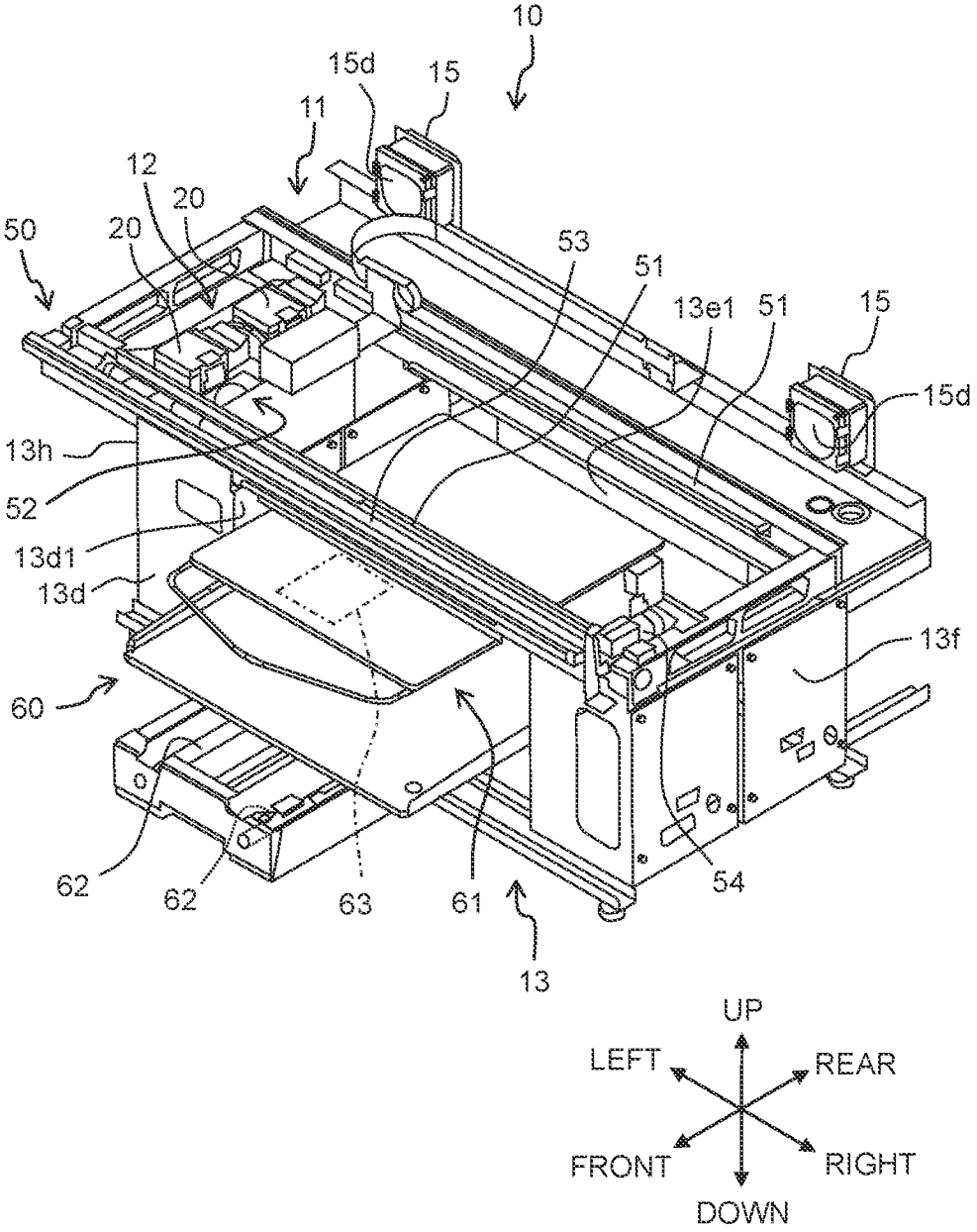
FIG. 1 is a perspective view of a liquid discharge apparatus according to an embodiment.

In the following, a first embodiment of the present disclosure will be specifically explained, with reference to the drawings. Note that in the following description, same reference numerals are affixed to same or corresponding elements throughout all the drawings, and any overlapping explanation therefor will be omitted.

Configuration of Liquid Discharge Apparatus

Figure 2:
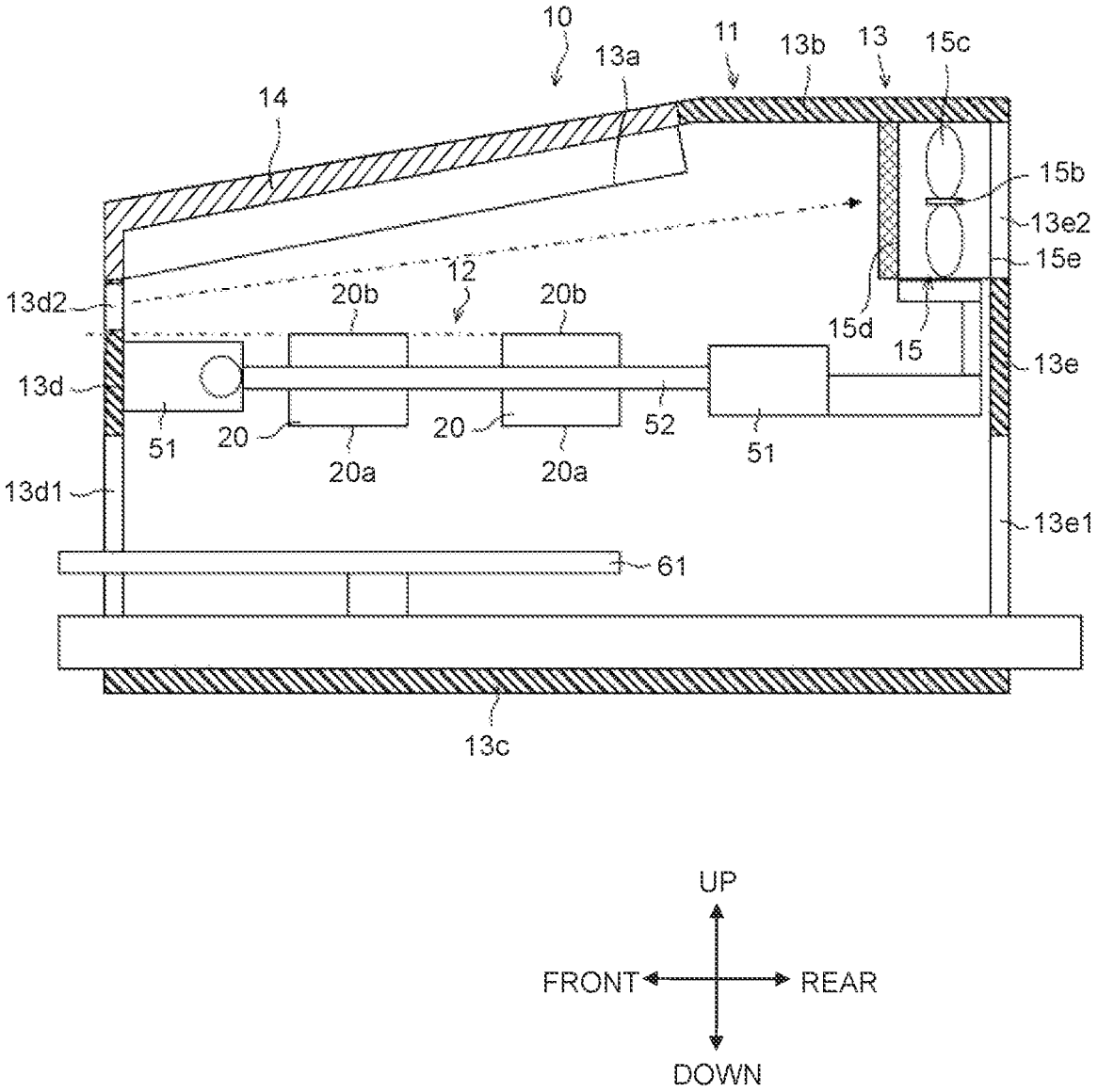
FIG. 2 is a cross-sectional view of the liquid discharge apparatus of FIG. 1, taken along a cross section orthogonal to the left-right direction.
Figure 3:
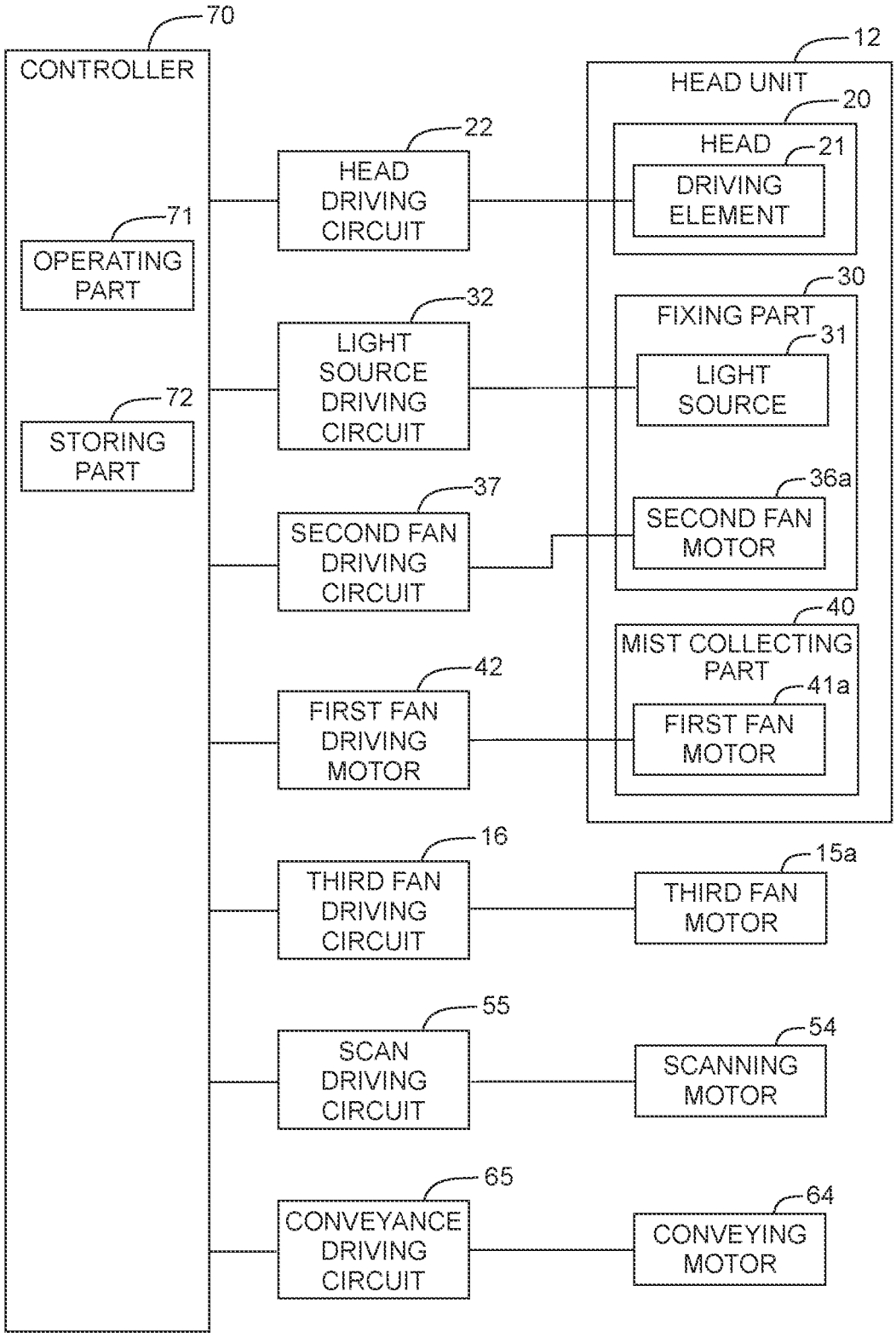
FIG. 3 is a functional block diagram indicating the configuration of the liquid discharge apparatus of FIG. 1.

A liquid discharge apparatus 10 according to an embodiment of the present disclosure is, for example, an ink-jet printer which discharges or ejects a liquid such as an ink, etc., from a head 20 onto a medium A (FIG. 4) so as to print an image on the medium A, as depicted in FIGS. 1 and 2. The medium A is exemplified, for example, by a sheet such as fabric, paper, etc., and a three-dimensional object such as a ball, a mug, etc. The liquid discharge apparatus 10 is provided with a casing 11, a head unit 12, a scanning device 50, a conveying device 60 and a controller 70 (FIG. 3). Note that the detail of the controller 70 will be described later on.

Figure 4:
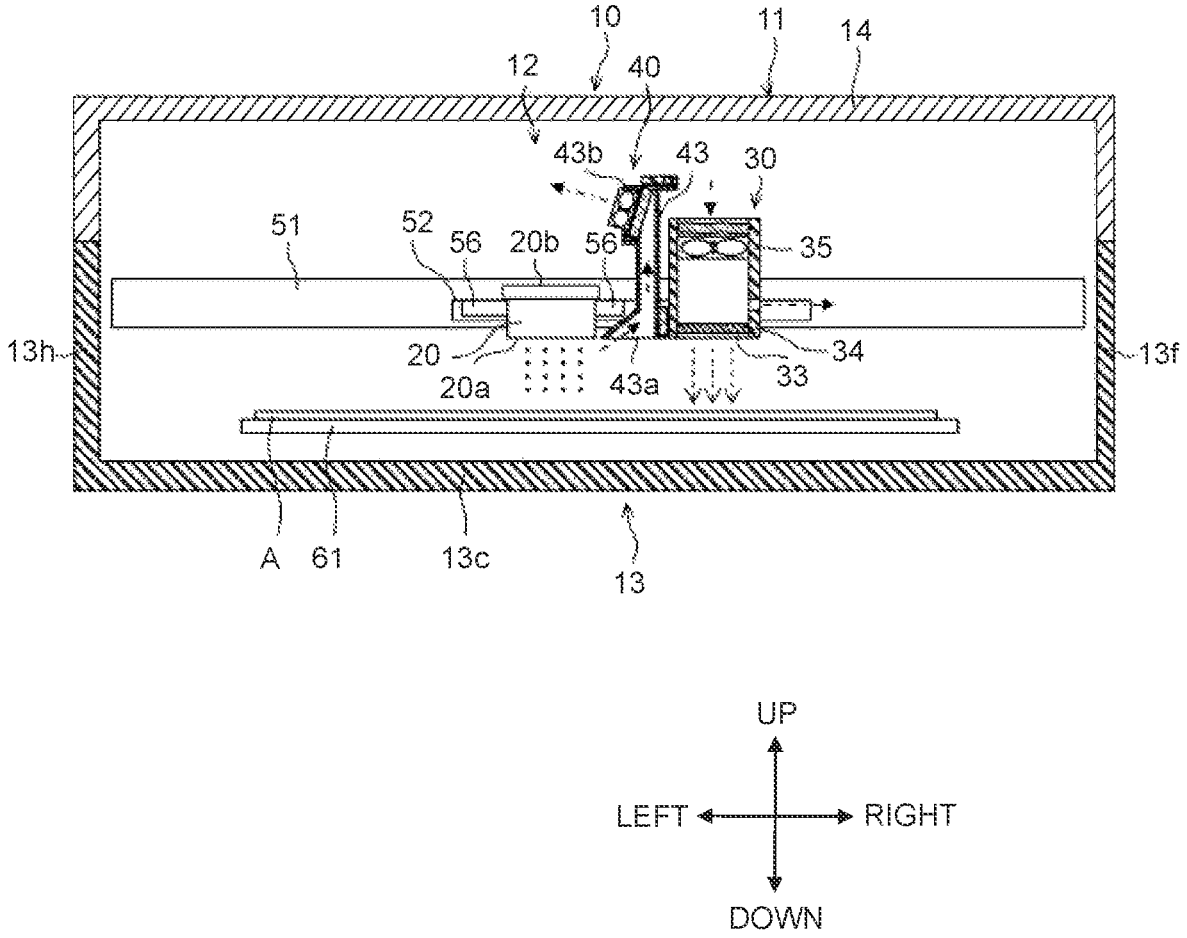
FIG. 4 is a cross-sectional view of the liquid discharge apparatus of FIG. 1, taken along a cross section orthogonal to the front-rear direction.

Further, the head unit 12 is provided with the head 20, a mist collector 40 and a fixing device 30, as depicted in FIG. 4. The head 20 has a discharge surface 20*a* from which the liquid is discharged or ejected, and an upper end surface 20*b* which is on a side opposite to the discharge surface 20*a*. A first direction, in which the head 20, the mist collector 40 and the fixing device 30 are arranged side by side in this order and which is parallel to the discharge surface 20*a* is referred to as a right direction, and a direction opposite to the first direction (right direction) is referred to as a left direction. A second direction, which is orthogonal to the discharge surface 20*a* and which is oriented from one end toward the other end of a first part 43*d* (to be described later on) is referred to as an up direction, and a direction opposite to the second direction (up direction) is referred to as a down direction. Further, a third direction, which is orthogonal to the first and second directions is referred to as a front direction, and a direction opposite to the third direction (front direction) is referred to as a rear direction. The first direction and the second direction are, for example, directions which cross each other (orthogonal to each other). Note, however, that the arrangement of the liquid discharge apparatus 10 is not limited to this.

As depicted in FIGS. 1 and 2, the casing 11 accommodates the head unit 12, the scanning device 50, the conveying device 60 and the controller 70. The casing 11 has a main body 13 of which upper part is opened, and a lid 14 configured to cover an upper opening 13*a* of the main body 13 so that the upper opening 13*a* is openable/closable. For example, the main body 13 is provided with the upper opening 13*a* at a part or portion of an upper part thereof (for example, a front part of the main body 13), and has an upper wall 13*b*, a lower wall 13*c*, a front wall (first wall 13*d*), a rear wall (second wall 13*e*), a right wall 13*f* and a left wall 13*h*. Note that the upper opening 13*a* is provided on the entirety of the upper part of the main body 13. In such a case, the main body 13 does not have the upper wall 13*b*, and has the lower wall 13*c*, the first wall 13*d*, the second wall 13*e*, the right wall 13*f* and the left wall 13*h*.

In the main body 13, an upper circumferential edge surrounding the circumference of the upper opening 13*a* is inclined so that a height in an up-down direction is lowered toward the front side. Accordingly, the lid 14 arranged on the upper circumferential edge is inclined to be lowered toward the front side, and covers the upper opening 13*a*. In the main body 13, a part thereof which is located on the rear side with respect to the upper opening 13*a* has a height in the up-down direction which is constant in a front-rear direction, and the upper wall 13*b* is arranged to be parallel to the lower wall 13*c*.

In a state that the upper opening 13*a* is covered by the lid 14, the casing 11 is provided with an internal space which is surrounded by the main body 13 and the lid 14. The main body 13 has a boxed shape. In the main body 13, the upper wall 13*b* is provided on a side opposite to the side of the lower wall 13*c*, with the internal space of the casing 11 being interposed between the upper wall 13*b* and the lower wall 13*c*; the first wall 13*d* is provided on a side opposite to the side of the second wall 13*e*, with the internal space of the casing 11 being interposed between the first wall 13*d* and the second wall 13*e*; and the right wall 13*f* is provided on a side opposite to the side of the left wall 13*h*, with the internal space of the casing 11 being interposed between the right wall 13*f* and the left wall 13*h*.

A front port 13*d*1 is opened in the first wall 13*d*, and a rear port 13*e*1 is opened in the second wall 13*e*. As seen from the front side, the front port 13*d*1 and the rear port 13*e*1 are arranged to overlap with each other. The internal space of the main body 13 communicates with the outside thereof, via the front port 13*d*1 and the rear port 13*e*1.

The scanning device 50 has a pair of scanning rails 51, a carriage 52, a driving belt 53, and a scanning motor 54, and causes the head unit 12 to move in a left-right direction. The pair of scanning rails 51 are a long member extending in the left-right direction, and are arranged to be parallel to each other so that the head unit 12 is interposed therebetween in the front-right direction. The carriage 52 has the head unit 12 mounted thereon, and is supported conveyably along the pair of scanning rails 51 in the left-right direction. The driving bel 53 is an endless belt extending along the pair of scanning rails 51 in the left-right direction, is connected to the carriage 52 and linked to the scanning motor 54 via a pulley. In a case that the scanning motor 54 drives the driving belt 53, the carriage 52 is thereby moved reciprocally in the left-right direction along the pair of scanning rails 51.

The conveying device 60 has a stage 61, a pair of conveying rails 62, a stage supporting stand 63 and a conveying motor 64 (FIG. 3). The medium A is placed on the upper surface of the stage 61, and the stage 61 defines a spacing distance in the up-down direction between the medium A and the head 20. The pair of conveying rails 62 extend in the front-rear direction, penetrate through the casing 11, project frontward from the front port 13*d*1 and project rearward from the rear port 13*e*1. The stage supporting stand 63 supports, for example, the stage 61 detachably and attachably, is supported to be movable in the front-rear direction along the pair of conveying rails 62, and is connected to the conveying motor 64. The conveying motor 64 drives the stage supporting stand 63 to thereby move the stage 61 in the front-rear direction.

The head unit 12 is provided with one or plurality of pieces of the head 20. In a case that the head 20 is provided as a plurality of heads 20, the plurality of heads 20 are arranged side by side in the front-rear direction. A tank is connected to each of the heads 20, and the liquid is supplied to each of the heads 20 from the tank. As depicted in FIG. 3, the head unit 12 is provided with the fixing device 30 of which number is same as the number of the head 20, and the mist collector 40 of which number is same as the number of the head 20, in addition to the head(s) 20. The head 20 has a driving element 21, the fixing device 30 has a light source 31 and a second fan motor 36*a*, and the mist collector 40 has a first fan motor 41*a*. The details of the head unit 12 will be described later on.

Configuration of Controller

As depicted in FIG. 3, the controller 70 is connected to the driving element 21 via a head driving circuit 22, and controls driving of the driving element 21. The controller 70 is connected to the light source 31 via a light source driving circuit 32, and controls driving of the light source 31. The controller 70 is connected to the second fan motor 36*a* via a second fan driving circuit 37, and controls driving of the second fan motor 36*a*. The controller 70 is connected to the first fan motor 41*a* via a first fan driving circuit 42, and controls driving of the first fan motor 41*a*. The controller 70 is connected to the scanning motor 54 via a scan driving circuit 55, and control driving of the scanning motor 54. The controller 70 is connected to the conveying motor 64 via a conveyance driving circuit 65, and controls driving of the conveying motor 64.

The controller 70 has an operating part 71 and a storing part 72. The storing part 72 is a memory to which the operating part 71 is accessible, and includes a RAM, a ROM, etc. The RAM temporarily stores a variety kinds of data such as a print job, etc. The ROM stores programs for performing a variety of kinds of data processing.

The operating part 71 includes a processor such as a CPU, etc., an integrated circuit such as an ASIC, etc. The operating part 71 executes a program stored in the ROM so as to control the driving element 21, the light source 31, the second fan motor 36*a*, the first fan motor 41*a*, the scanning motor 54 and the conveying motor 64, thereby executing a print processing. The details of the print processing will be described later on.

Configuration of Head Unit

Figure 5:
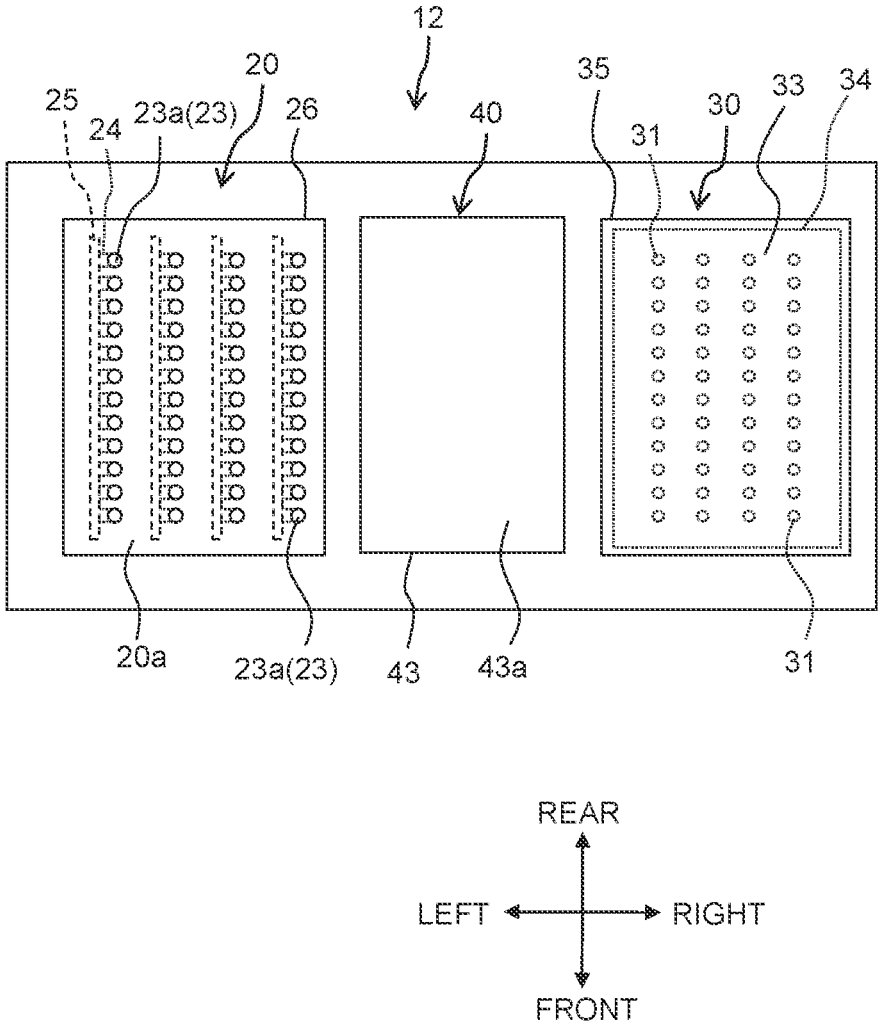
FIG. 5 is a schematic view of a head unit of FIG. 1, as seen from therebelow.

In the head unit 12, as depicted in FIGS. 4 and 5, the head 20, the mist collector 40 and the fixing device 30 are arranged side by side in this order form left to right. For example, in a case that a unidirectional printing wherein the liquid is ejected or discharged while the head 20 is moving to the left side and the liquid is not ejected while the head 20 is moving to the right side, the fixing device 30 and the mist collector 40 are arranged on the upstream side (right side) in a moving direction (left side) of this printing, with respect to the head 20. Accordingly, the fixing device 30 and the mist collector 40 move following the head 20 ejecting the liquid.

The head 20 is connected to the carriage 52 (FIG. 1) by a connecting part 56, and the head 20 has a plurality of nozzles 23, a plurality of individual channels 24, a common channel 25, a channel forming body 26, and a plurality of pieces of the driving element 21 (FIG. 3). The plurality of nozzle 23 are arranged side by side in the front-rear direction with a predetermined spacing distance therebetween so as to form a nozzle row (array); further, a plurality of pieces of the nozzle row are arranged side by side in the left-right direction with a predetermined spacing distance therebetween. Note that the nozzle row may be inclined with respect to the front-rear direction.

The channel forming body 26 has, for example, a shape which is rectangular parallelepiped, and has the plurality of nozzles 23, the plurality of individual channels 24 and the common channel 25 formed therein, and forward ends of the plurality of nozzles 23 (nozzle holes 23*a*) are opened in a lower surface (discharge surface 20*a*) of the channel forming body 26. The common channel 25 extends in the front-rear direction, and is connected to the tank. The plurality of individual channels 24 are provided to be branched from the common channel 25. Each of the plurality of individual channels 24 has an upstream end connected to the common channel 25, and a downstream end connected to one of the plurality of nozzles 23. The plurality of nozzles 23 forming the nozzle row communicate with the same common channel 25. Accordingly, the liquid is supplied from the tank to the common channel 25, and is branched into the plurality of individual channels 24 while flowing through the common channel 25 in the front-rear direction, and is supplied to the plurality of nozzles 23.

The driving element 21 is a piezoelectric element, etc., and is provided corresponding to the each of the plurality of individual channels 24. The driving element 21 is driven by the controller 70 (FIG. 3) so as to change the volume of each of the plurality of individual channels 24. With this, a pressure for ejecting or discharging the liquid from the nozzle hole 23*a* is applied to the liquid in each of the plurality of individual channels 24. The liquid is a liquid which is curable by an energy of a light.

Figure 6:
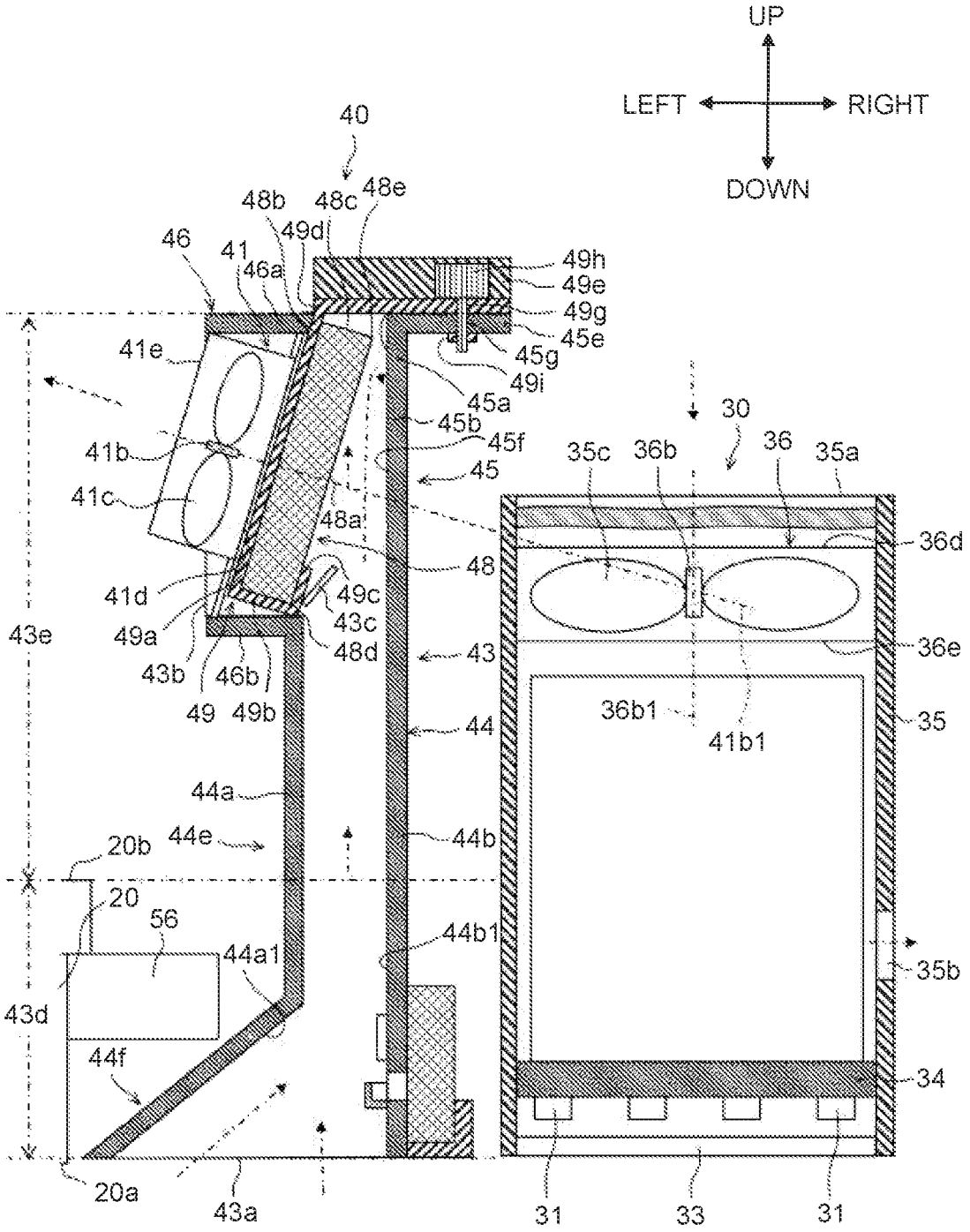
FIG. 6 is a cross-sectional view of a mist collector of FIG. 4, taken along a cross section orthogonal to the front-rear direction.

As depicted in FIGS. 5 and 6, the fixing device 30 has a plurality of pieces of the light source 31, a cover 33, a light source substrate 34, a case 35 and a second fan 36. Note that the case 35 may further accommodate a heat sink. In such a case, the heat sink is arranged between the second fan 36 and the light source substrate 34, and is attached to the light source substrate 34. With this, the air from the second fan 36 is received by the heat sink to thereby cool the light source substrate 34 and the plurality of light sources 31. Note that it is not necessarily indispensable that the second fan 36 and/or the head sink is/are provided on the fixing device 30.

Each of the plurality of light sources 31 is a generating source emitting a light (for example, ultraviolet ray) curing the liquid ejected or discharged from the nozzles 23 and landed on the medium A, and is, for example, a LED and arranged on the lower surface of the light source substrate 34. The cover 33 has a transmissivity allowing the light from each of the plurality of light sources 31 to transmit therethrough, and is attached to the case 35 so as to cover the plurality of light sources 31. The light source substrate 34 has the plurality of light sources 31 and the light source driving circuit 32 (FIG. 3) mounted thereon.

The case 35 has, for example, a shape which is rectangular parallelepiped having an internal space, and accommodates the plurality of light sources 31, the light source substrate 34 and the second fan 36 in the internal space. The case 35 has a lower-side opening, an upper-side opening (inflow port 35*a*) and an outflow port 35*b*, and the lower-side opening is covered by the cover 33. Accordingly, the internal space of the case 35 communicates with the outside of the case 35 via the inflow port 35*a* and the outflow port 35*b*. Note that a filter may be attached to the case 35 so as to cover the inflow port 35*a*. With this, in a case that the air flows into the case 35 via the inflow port 35*a*, a mist included in the air can be collected by a filter.

The outflow port 35*b* is opened in the case 35 at a part thereof between the second fan 36 and the light source substrate 34. The outflow port 35*b* is provided in the case 35 at a part or location thereof on a side (right side) opposite to a side (left side) of the mist collector 40 in the left-right direction. Accordingly, the air flowing out from the outflow port 35*b* flows in a direction away from the mist collector 40.

The second fan 36 has a second rotational shaft 36*b*, a plurality of second fins 36*c*, a second suction port 36*d* and a second blowout port 36*e*. The second rotational shaft 36*b* extends in the up-down direction, is connected to the second fan motor 36*a* (FIG. 3), and rotates by driving of the second fan motor 36*a*. The plurality of second fins 36*c* are connected to the second rotational shaft 36*b*, and rotate about the second rotational shaft 36*b*.

The second fan 36 is arranged so that the second blowout port 36*a* faces or is opposite to the light source substrate 34 and that the second suction port 36*d* faces the inflow port 35*a*. The second fan 36 sucks the air from the second suction port 36*d*, and blows out the air from the second blowout port 36*e*. With this, the air inflows from the outside of the case 35 into the inside of the inflow port 35*a*, passes through the second fan 36 and is blown to the light source substrate 34, thereby cooling the light source substrate 34.

The mist collector 40 is arranged between the head 20 and the fixing device 30 in the left-right direction. The mist collector 40 extends to a location above the head 20 and the fixing device 30, and has an upper end arranged at a location above an upper end of the head 20 and an upper end of the fixing device 30.

Figure 7:
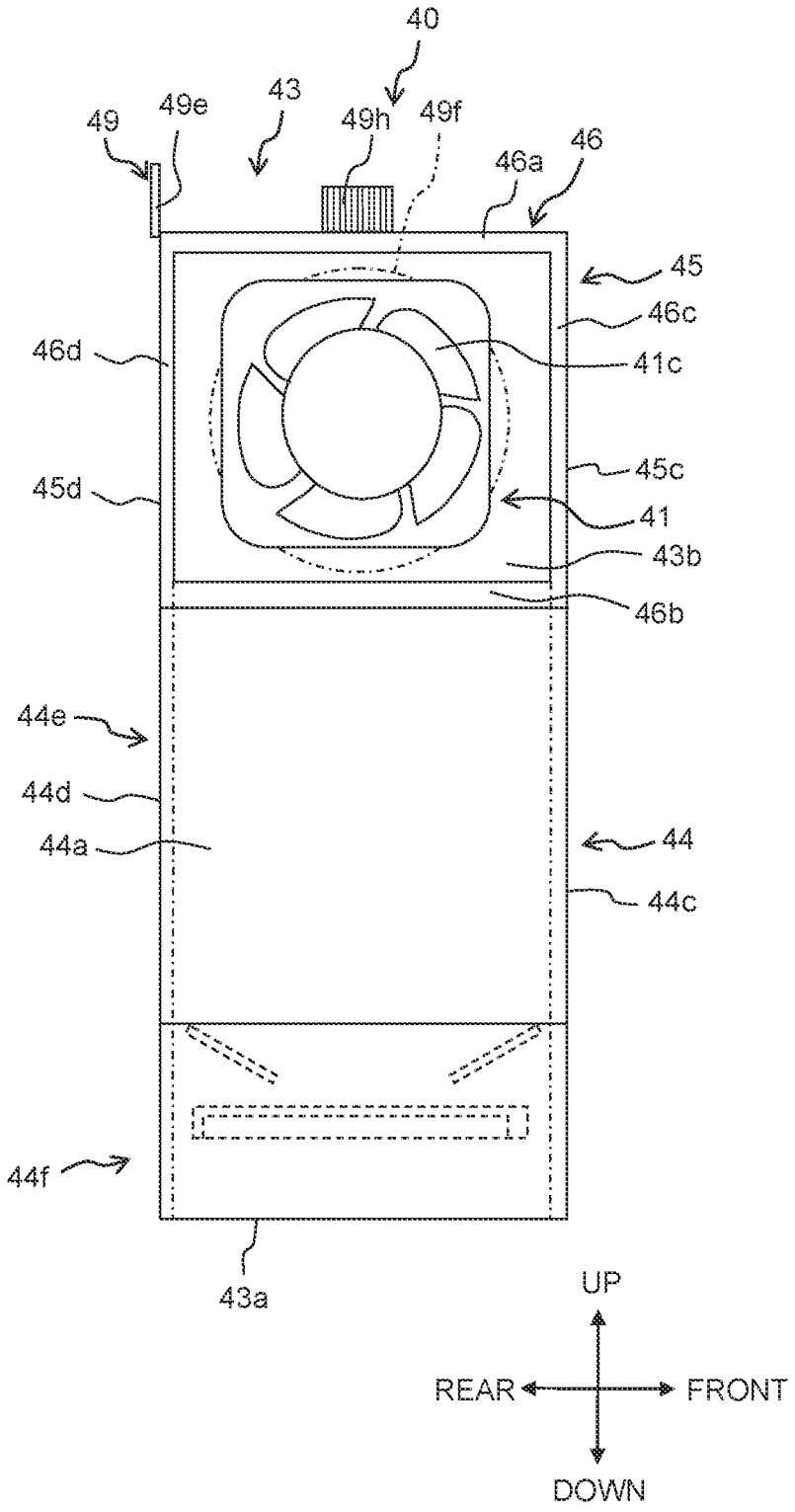
FIG. 7 is a schematic view of the mist collector of FIG. 5, as seen from the left side.

As depicted in FIGS. 6 and 7, the mist collector 40 is provided with an air channel 43 configured to flow the air therethrough, and collects the mist of the liquid. The air channel 43 has a suction port 43*a* via which the air is sucked, and an exhaust port 43*b* via which the air is exhausted.

The suction port 43*a* is provided on one end of the air channel 43, and faces downward with respect to the air channel 43. The suction port 43*a* is arranged, in the left-right direction, between the discharge surface 20*a* of the head 20 and the light sources 31 of the fixing device 30.

The exhaust port 43*b* is provided on the other end of the air channel 43, and is arranged on a location above the suction port 43*a*. The exhaust port 43*b* is located, in the up-down direction, above the upper end surface 20*b* of the head 20, and at least a part of the exhaust port 43*b* is located above the upper end of the fixing device 30. Accordingly, in the up-down direction, the exhaust port 43*b* has a lower end thereof located above the upper end surface 20*b* of the head 20, and an upper end thereof located above the inflow port 35*a* which is located at the upper end of the fixing device 30.

Further, the exhaust port 43*b* is opened in any one of directions which are: a direction including a direction (for example, left direction) opposite to the first direction (for example, right direction) as a directional component thereof, a third direction (for example, front direction) orthogonal to the first and second directions, and a direction (for example, rear direction) opposite to the third direction; the air is exhausted from the exhaust port 43*b* in a direction in which the exhaust port 43*b* is opened (opening direction).

Namely, the exhaust port 43*b* is oriented, for example, in any one of directions which are: the direction including the left direction as a directional component thereof, the front direction and the rear direction. The direction including the left direction as a directional component thereof includes, for example, left direction, upper left direction, lower left direction, left front direction, left rear direction, etc. Note that the upper left direction is a direction including the left direction and up direction as directional components thereof. The exhaust port 43*b* preferably is opened in the direction including the direction (for example, left direction) opposite to the first direction, as a directional component thereof. In the example depicted in FIG. 6, the exhaust port 43*b* is oriented in the left direction, and is opened at a side, in the air channel 43, which is closer to the side of the head 20 than to the side of the fixing device 30.

Further, the exhaust port 43*b* is not oriented in the up direction, and the air is not exhausted from the exhaust port 43*b* upward. Furthermore, the opening direction of the exhaust port 43*b* does not include the right direction as a directional component thereof. Accordingly, the exhaust port 43*b* is not oriented in the right direction, upper right direction, lower right direction, right front direction and right rear direction. Therefore, the air is not exhausted from the exhaust port 43*b* rightward.

The air channel 43 has a tubular shape having a hollow part, and the air flows in the hollow part. The air channel 43 has, in an inner side thereof, an inner surface (inner wall) forming the hollow part, and an outer surface (outer wall) on a side opposite to the inner surface (inner wall). The outer wall is exposed to the outside of the air channel 43. The air channel 43 has a vertical part 44, a corner part 45 and a horizontal part 46, and has a tubular shape which is bent at the corner part 45. Although the example depicted in FIG. 6 is bent by 90 degrees at the corner part 45, the bending angle is not limited to this. For example, it is allowable that the hollow part 43 is bent at the corner part 45 by an angle greater than 90 degrees (obtuse angle), or by an angle less than 90 degrees (acute angle).

The corner part 45 is provided, in the air channel 43, at a location between the suction port 43*a* and the exhaust port 43*b*. The vertical part 44 extends upward from the suction port 43*a* up to the corner part 45, and the horizontal part 46 extends leftward from the corner part 45 up to the exhaust port 43*b*. Note that although the first direction is referred to as "right" or "rightward", and the second direction is referred to as "up" or "upward", the arrangement of the mist collector 40 is not limited to this.

The vertical part 44 has, for example, a tubular shape of which cross section orthogonal to the up-down direction is rectangular, and has a first left wall 44*a*, a first right wall 44*b*, a first front wall 44*c* and a first rear wall 44*d*. These walls 44*a* to 44*d* each have a shape of a flat plate, and have respective lower ends surrounding the circumference (periphery) of the suction port 43*a*, and extend upward from the respective lower ends. An inner surface (first right inner surface 44*b*1) of the first right wall 44*b* and an inner surface (second left inner surface 44*a*1) of the first left wall 44*a* face each other, and the second left inner surface 44*a*1 is closer to the head 20 than the first right inner surface 44*b*1. The first front wall 44*c* and the first rear wall 44*d* have respective inner surfaces face each other and are parallel to each other, and are arranged between the first left wall 44*a* and the first right wall 44*b* and connect ends of the first left and right walls 44*a* and 44*b*.

The vertical part 44 has a straight tube part 44*e* and an expanded diameter part 44*f* in the up-down direction. The straight tube part 44*e* has a cross section orthogonal to the up-don direction which is constant over the entirety of the straight tube part 44*e*, and has a lower end connected to an upper end of the expanded diameter part 44*f*. In the straight tube part 44*e*, the first right inner surface 44*b*1 and the second left inner surface 44*a*1 are arranged to be parallel to each other.

The expanded diameter part 44*f* has the suction port 43*a* at a lower end thereof, and has a cross section orthogonal to the up-down direction is expanded downwardly. In the expanded diameter part 44*f*, the first right wall 44*b* extends in the up-down direction, and the first left wall 44*a* is inclined with respect to the first right wall 44*b* so that the first left wall 44*a* extends leftward in the down direction.

Accordingly, the first right inner surface 44*b*1 is flat, and extends upward from the suction port 43*a* over the expanded diameter part 44*f* and the straight tube part 44*e*. The second left inner surface 44*a*1 is parallel to the first right inner surface 44*b*1 in the straight tube part 44*e*, is inclined, in the expanded diameter part 44*f*, with respect to the first right inner wall surface 44*b*1 to the left side progressively in the down direction, and extends toward the head 20 at a location below the connecting part 56. The second left inner surface 44*a*1 may be formed of a plane inclined linearly, or of a curved surface which is curved. In a case that the second left inner surface 44*a*1 is inclined linearly, the second left inner surface 44*a*1 may be inclined while changing the inclination angle thereof incrementally or in a stepwise manner.

The horizontal part 46 has, for example, a tubed shape of which cross section orthogonal to the left direction is rectangular, and has a second upper wall 46*a*, a second lower wall 46*b*, a second front wall 46*c* and a second rear wall 46*d*. These walls 46*a* to 46*d* each have a shape of a flat plate, and have respective left ends surrounding the circumference (periphery) of the exhaust port 43*b*, and extend rightward from the respective left ends. Accordingly, the exhaust port 43*b* is provided on a left end opening of the horizontal part 46.

An inner surface of the second upper wall 46*a* and an inner surface of the second lower wall 46*b* face each other, and are arranged to be parallel to each other. An inner surface of the second front wall 46*c* and an inner surface of the second rear surface 46*d* face each other, arranged to be parallel to each other, are arranged between the second upper wall 46*a* and the second lower wall 46*b*, and connect ends of the second upper wall 46*a* and the second lower wall 46*b*.

The corner part 45 has a lower end connected to an upper end of the vertical part 44 and a left end connected to a right end of the horizontal part 46. The corner part 45 has an opening part 45*a*, a third right wall 45*b*, a third front wall 45*c*, a third rear wall 45*d* and a connecting plate 45*e*. The third front wall 45*c* is connected to the first front wall 44*c* and the second front wall 46*c*, and these walls 45*c*, 44*c* and 46*c* are arranged on a mutually same plane. The third rear wall 45*d* is connected to the first rear wall 44*d* and the second rear wall 46*d*, and these walls 45*d*, 44*d* and 46*d* are arranged on a mutually same plane.

The third right wall 45*b* is connected to the first right wall 44*b*. The third right wall 45*b* has an inner surface (third right inner surface 45*f*) connected to the first right inner surface 44*b*1. The first right inner surface 44*b*1 and the third right inner surface 45*f* are arranged on a mutually same plane in the inside of the air channel 43, and flat and orthogonal in the left-right direction. The third right inner surface 45*f* faces the exhaust port 43*b* in the left-right direction, with the filter 48 being interposed therebetween.

The third right wall 45*b* has an outer surface (third right outer surface) on a side opposite to the third right inner surface 45*f*, and the first right wall 44*b* has an outer surface (first right outer surface) on a side opposite to the first right inner surface 44*b*1. The third right outer surface and the first right outer surface are arranged in a mutually same plane at the outside of the air channel 43, are flat, and orthogonal to the left-right direction. At least a part of the third right outer surface and the first right outer surface face the fixing device 30.

The opening part 45*a* is opened at an upper end of the corner part 45, and has a size allowing a holder 49 to pass therethrough. The opening part 45*a* is arranged in the air channel 43 at a location thereof which is, in the up-down direction, on a side opposite to the side of the suction port 43*a*, and is arranged between the second upper wall 46*a* and the connecting plate 45*e* in the left-right direction. A circumferential edge part surrounding the circumference of the opening part 45*a* is formed of a right end of the second upper wall 46*a*, an upper end of the third right wall 45*b*, an upper end of the third front wall 45*c* and an upper end of the third rear wall 45*d*. The opening 45*a* faces the upper opening 13*a* (FIG. 2) of the main body 13.

The connecting plate 45*e* has a shape of a flat plate, projects rightward from the upper end of the third right wall 45*b*, and is arranged at a same height with the second upper wall 46*a* in the up-down direction. The connecting plate 45*e* is provided with a first fixing hole 45*g* for fixing the holder 49 to the air channel 43, and the first fixing hole 45*g* penetrates the connecting plate 45*e* in the up-down direction.

Further, the air channel 43 has a first part 43*d* and a second part 43*e*. The first part 43*d* is arranged between the head 20 and the fixing device 30 in the left-right direction, and has the suction port 43*a* at a lower end thereof in the up-down direction. Accordingly, the first part 43*d* is a part, of the air channel 43, which is arranged between the head 20 and the fixing device 30; the first part 43*d* is, for example, in the vertical part 44, the expanded diameter part 44*f*, and a part, of the straight tube part 44*e*, which is located at a same height as the upper end surface 20*b* and below the upper end surface 20*b*. The second part 43*e* has a lower end connected to an upper end of the first part 43*d*. The second part 43*e* is, for example, a part, of the air channel 43, which is located above a lower one of the upper end surface 20*b* of the head 20 and the inflow port 35*a* of the fixing device 30; the second part 43*e* is, for example, a part, of the straight tube part 44*e*, which is located above the upper end surface 20*b*, the corner part 45 and the horizontal part 46.

The second part 43*e* has the exhaust port 43*b*. The exhaust port 43*b* is arranged, in the second part 43*e*, at a location above the upper end surface 20*b* of the head 20 in the up-down direction, and faces to a side (left) opposite to the side of the fixing device 30 (right) in the left-right direction. With this, the air exhausted from the exhaust port 43*b* flows in a direction away from the fixing device 30, at the location above the head 20.

The mist collector 40 is provided with a catching part 47 (catching and collection device 47), a filter 48, a holder 49 and a first fan 41, in addition to the air channel 43. The catching part 47 is provided on the first right wall 44*b*, and is configured to catch and collect the liquid adhered to the first inner wall 44*b* of the first right wall 44. The catching part 47 has a through hole 47*a*, a guiding plate 47*b*, two projected parts 47*c*, an absorbing body 47*d* and a receiving part 47*e*.

The through hole 47*a* is provided on the expanded diameter part 44*f* of the first part 44, extends to be long in the front-rear direction, and penetrates through the first right wall 44*b* in the left-right direction between the first inner wall 44*b*1 and the first right outer surface.

Each of the two projected parts 47*c* is projected from the first inner wall 44*b*1, and has an elongated shape. The two projected parts 47*c* are arranged at a location above the through hole 47*a*, with a spacing distance therebetween in the left-right direction. The two projected parts 47*c* are provided so as to form a pair in the front-rear direction, and arranged in a shape of a letter "V" so that the two projected parts 47*c* approach closely to each other progressively in a downward direction as seen along the left-right direction, and that the respective lower ends of the two projected parts 47*c* are separated from each other. The through hole 47*a* is positioned at a location below the lower ends of the two projected parts 47*c*.

The guiding plate 47*b* projects leftward from the lower edge of the through hole 47*a*, and extends upward. The guiding plate 47*b* is arranged with a spacing distance with respect to the through hole 47*a* so that the guiding plate 47*b* overlaps with the through hole 47*a* in a case that the guiding plate 47*b* is seen from the left side thereof.

The receiving part 47*e* is arranged at the outside of the air channel 43, and is attached to the first right outer surface of the first right wall 44*b*, at a location below the through hole 47*a*. The receiving part 47*e* is opened at an upper end thereof, and has a shape of a box having an internal space.

The absorbing body 47*d* is formed, for example, of a porous member such as sponge, etc., and has, for example, a shape of rectangular parallelepiped. The absorbing body 47*d* is fitted to the receiving part 47*e* so as to cover the through hole 47*a*. The absorbing body 47*d* has an inner surface making contact with the first right outer surface, and an upper surface arranged at a location above the through hole 47*a*.

The filter 48 is formed, for example, of a porous material such as sponge, etc., has, for example, a shape of a rectangular parallelepiped, and is arranged inside the air channel 43 so as to cover the exhaust port 43*b*. The filter 48 has a right surface (filter surface) 48*a*, a left surface 48*b* and a side surface 48*c*.

The right surface 48*a* faces the third right inner surface 45*f* of the corner part 45, and is farther away from the exhaust port 43*b* than the left surface 48*b* in the left-right direction. The left surface 48*b* is a face on a side opposite to the right surface 48*a*. The right surface 48*a* and the left surface 48*b* are flat. Note that, however, the right surface 48*a* and the left surface 48*b* may be curved, and/or may have convexities and concavities.

The right surface 48*a* has, in the up-down direction, a right lower end 48*d* and a right upper end 48*e* which is located above the right lower end 48*d*. The right lower end 48*d* is located to be closer to the suction port 43*a* than the right upper end 48*e* in the up-down direction, and is located to be closer to the exhaust port 43*b* than the right upper end 48*e* in the left-right direction. The right lower end 48*d* is arranged in the horizontal part 46 of the air channel 43, and is arranged on the second lower wall 46*b* in the horizontal part 46. A lower surface of the filter 48 faces the second lower wall 46*b*.

The right upper end 48*e* is located closer to the right side than the right lower end 48*d*, and is arranged inside the corner part 45 of the air channel 43. In the corner part 45, the right upper end 48*e* is closer to the opening part 45*a* than the right lower end 48*d* in the up-down direction, and is closer to the third right inner surface 45*f* than the right lower end 48*d* in the left-right direction. Accordingly, the right surface 48*a* is inclined rightward and upward from the right lower end 48*d* toward the right upper end 48*e* so that the right surface 48*a* approaches toward the third right inner surface 45*f*, and faces the side of the vertical part 44.

In the left-right direction, a spacing distance between the right upper end 48*e* and the right end (third right inner surface 450 of the corner part 45 is narrower than a spacing distance between the right upper end 48*e* and the left end of the corner part 45. For example, the spacing distance between the right upper end 48*e* and the third right inner surface 45*f* is not more than half the size in the left-right direction of the corner part 45, and is not more than half the size in the left-right direction of the vertical part 44 (the spacing distance between the first right inner surface 44*b*1 of the first right wall 44*b* and the second left inner surface 44*a*1 of the first left wall 44*a*).

The side surface 48*c* extends between the right surface 48*a* and the left surface 48*b* along the circumferential edges of the right and left surfaces 48*a* and 48*b*, and connecting the right surface 48*a* and the left surface 48*b*. The side surface 48*c* has an upper surface, a lower surface, a front surface and a rear surface. The upper surface faces the opening part 45*a*, and is a downward gradient (downgrade) from the upper end of the left surface 48*b* toward the right upper end 48*e* of the filter 48, and is inclined rightward and downward. Accordingly, a gap is defined between the right upper end 48*e* and the circumferential edge part of the opening 45*a*.

The holder 49 has, for example, a left holding plate 49*a*, a lower holding plate 49*b*, a right holding plate 49*c*, a covering part 49*d* and a handle part 49*e*, and holds, with the above-described components 49*a* to 49*e*, the filter 48 detachably and attachably with respect to the air channel 43 via the opening 45*a*. The left holding plate 49*a*, the lower holding plate 49*b*, the right holding plate 49*c*, the covering part 49*d* and the handle part 49*e* have a shape of a flat plate.

The left holding plate 49*e* makes contact with the left surface 48*b* of the filter 48 to thereby support the left surface 48*b* of the filter 48. The left holding plate 49*a* is arranged between the filter 48 and the first fan 41, and has a communicating hole 49*f* in a range thereof facing the first fan 41. Since the communicating hole 49*f* penetrates through the left holding plate 49*a*, the air passing through the filter 48 passes through the communicating hole 49*f* and is sucked to the first fan 41.

A left end of the lower holding plate 49*b* is connected to a lower end of the left holding plate 49*a*, and extends therefrom to the right side in a direction orthogonal to the left holding plate 49*a*, makes contact with a lower surface of the filter 48 and supports the lower surface of the filter 48. A lower end of the right holding plate 49*c* is connected to a right end of the lower holding plate 49*b*, and extends therefrom to the upper side in a direction orthogonal to the lower holding plate 49*b*, makes contact with the right surface 48*a* of the filter 48 and supports the right surface 48*a* of the filter 48. In the up-down direction, the right holding plate 49*c* has a length shorter than that of the left holding plate 49*a*, and is arranged at a location lower than (below) the communicating hole 49*f*. With this, the left holding plate 49*a*, the lower holding plate 49*b* and the right holding plate 49*c* cover the lower part of the filter 48 so that the air is passable through the filter 48 and the communicating hole 49*f*.

A left end of the covering part 49*d* is connected to an upper end of the left holding plate 49*a*, and extends therefrom rightward. A left area in the covering part 49*d* covers the upper surface of the filter 48, is arranged on the circumferential edge part of the opening 45*a* of the air channel 43, closes the opening part 45*a* and constructs an upper wall of the air channel 43.

Further, a right area of the covering part 49*d* is arranged on the connecting plate 45*e*. The covering part 49*d* has a second fixing hole 49*a* at a position corresponding to the first fixing hole 45*g* of the connecting plate 45*e*, and the second fixing hole 49*g* penetrates through the connecting plate 45*e* in the up-down direction. By inserting a bolt 49*h* into the first fixing hole 45*g* and the second fixing hole 49*g*, and by fastening the bolt 49*h* with a nut 49*i*, the holder 49 is fixed to the air channel 43.

The handle part 49*e* is arranged in the right area, in the covering part 49*d*, which corresponds to the connecting plate 45*e*, and the handle part 49*e* has a lower end which is connected to a rear end of the covering part 49*d*, and from which the handle part 49*e* stands upward. In a case that a user grasps the handle part 49*e* and inserts the holder 49 from the opening part 45*a* into the inside of the air channel 43, it is thereby possible to attach the holder 49 in the inside of the air channel 43. Further, in a case that the user grasps the handle part 49*e* and pulls or withdraws the holder 49 out from the opening part 45*a* and to the outside of the air channel 43, it is thereby possible to detach or remove the holder 49 from the air channel 43.

A guide 43*c*, configured to attach/detach the holder 49 in such a manner, is provided on the air channel 43. The guide 43*c* is arranged in the corner part 45 which is inside the air channel 43, at a location below the opening part 45*a* and on the right side with respect to the horizontal part 46. The guide 43*c* is provided, for example, on each of the inner surface (third front inner surface) of the third front wall 45*c* and the inner surface (third rear inner surface) of the third rear wall 45*d* which face each other. The guide 43*c* projects from each of the third front inner surface and the third rear inner surface, and extends to the left side and extends in the down direction.

With this, in a case that the holder 49 is inserted from the opening part 45*a* into the inside of the air channel 43, a right lower corner of the holder 49 abuts against or makes contact with the guide 43*c*, and is guided to a predetermined position of the horizontal part 46 along the guide 43*c*. The holder 49 is supported by the guide 43*c* at the predetermined position. On the other hand, in a case that the holder 49 is taken from the opening part 45*a* to the outside of the air channel 43, the holder 49 is lifted up to thereby allow the right lower corner of the holder 49 to be guided to the opening part 45*a* along the guide 43*c*. Accordingly, by moving the holder 49 in the up-down direction, it is possible to easily attach and detach the holder 49 with respect to the air channel 43.

The first fan 41 has a first rotational shaft 41*b*, a plurality of first fins 41*c*, a first suction port 41*d* and a first blowout port 41*e*, whereby sucking air including a mist of the liquid discharged from the head 20 into the air channel 43. The first fan 41 is arranged in the inside of the horizontal part 46.

The first rotational shaft 41*b* crosses (for example, is orthogonal to) the up-down direction, and is inclined with respect to the up-down direction so that a left part of the first rotational shaft 41*b* is located on the upper side. For example, an extending direction 41*b*1 in which the first rotational shaft 41*b* extends is not parallel to an extending direction 36*b*1 in which the second rotational shaft 36*b* of the second fan 36 of the fixing device 30 extends, and is, for example, crosses (for example, is orthogonal to) the extending direction 36*b*1. The first rotational shaft 41*b* is connected to the first fan motor 41*a* (FIG. 3), and rotates by driving of the first fan motor 41*a*. The plurality of first fins 41*c* are connected to the first rotational shaft 41*b* and rotate about the first rotational shaft 41*b*.

The first suction port 41*d* faces the left surface 48*b* of the filter 48, via the communicating hole 49*f* of the holder 49. The first suction port 41*d* is located on the right side with respect to the first blowout port 41*e*, and is arranged so that the first suction port 41*d* and the first blowout port 41*e* sandwich the first rotational shaft 41*b* therebetween in the left-right direction. The first blowout port 41*e* is arranged at the outer side with respect to the exhaust port 43*b* of the air channel 43. Note that, however, the first blowout port 41*e* may be arranged in the inside of the air channel 43 with respect to the exhaust port 43*b*.

Printing Processing

In such a liquid discharging head 10, as depicted in FIG. 3, the controller 70 controls the scanning motor 54 to thereby execute a moving operation of moving the head unit 12 in the left-right direction. Further, the controller 70 controls the driving element 21 to thereby execute a discharging operation of discharging (ejecting) the liquid from the head 20. The controller 70 controls the light source 31 to thereby execute a fixing operation of irradiating (applying) the light from the light source 31 so as to fix the liquid to the medium A. Further, the controller 70 controls the conveying motor 64 to thereby execute a conveying operation of conveying the medium A frontward by a predetermined amount. Furthermore, the liquid discharge apparatus 10 alternately repeats an image recording processing including the moving operation, the discharging operation and the fixing operation, and the conveying operation so as to advances the printing processing.

In the image recording processing, as depicted in FIG. 4, the head 20 discharges or ejects the liquid from the nozzles 23 of the head 20, while the head 20 is moving to the left side. With this, the liquid lands on the medium A, on the stage 61, which faces the discharge surface 20*a* of the head 20. Further, the light is applied from the light source 31 while the fixing device 30 is moving to the left side following the head 20. With this, the light is applied to the liquid on the medium A, on the stage 61, which faces the light source 31. The liquid is cured by the light and is fixed to the medium A. Accordingly, an image is formed on the medium A by the liquid.

Further, in the image recording processing, the first fan 41 is driven while the mist collector 40 is moving to the left side following the head 20. With this, the air containing the mist of the liquid discharged from the head 20 is sucked into the air channel 43 from the suction port 43*a* of the mist collecting section 40. In the air channel 43, the air flows upward in the vertical part 44, changes a direction of the flow thereof at the corner part 45, and then flows to the horizontal part 46. In the corner part 45 and the horizontal part 46, the air passes through the filter 48, and the mist contained in the air is caught and collected by the filter 48. Then, in the horizontal part 46, the air passes through the first fan 41, from the first suction port 41*d* to the first blowout port 41*e*, and is exhausted or discharged from the exhaust port 43*b*.

Further, since the air from the head 20 flows from the left side of the mist collector 40 into the vertical part 44, via the suction port 43*a*, the mist included in the air is likely to adhere to the first inner wall 44*b*1 of the first right wall 44*b*, among the vertical part 44. Furthermore, in a case that the direction of the flow of the air is changed from upward to leftward at the corner part 45, a convection flowing rightward is generated, and thus the mist included in the convection adheres to the facing surface 45*f*.

With this, the mist adhered to the first inner wall 44*b*1 and the facing surface 45*f* is liquified, and the liquid (liquified mist) flows downward along the facing surface 45*f* and the first inner wall 44*b*1. This liquid flows to the side of the through hole 47*a* along the projected parts 47*c* on the first inner wall 44*b*1, and is guided to the through hole 47*a*. Further, the liquid which has flowed across the through hole 47*a* from the upper side to the lower side is guided to the through hole 47*a* by the guiding plate 47*b*. Accordingly, the liquid is guided by the through hole 47*a* and passes through the through hole 47*a*. Then, the liquid is absorbed, caught and collected by the absorbing body 47*d* covering the through hole 47*a*, and is received by the receiving part 47*e*.

In such a manner, the mist collector 40 collects the mist from the head 20 by the filter 48 and the catching part 47. With this, it is possible to reduce any adhesion of the mist to the fixing device 30 which is arranged on the upstream side, in the moving direction, of the mist collector 40; and regarding the intensity of the light from the light source 31 of the fixing device 30, it is possible to suppress any lowering in the intensity of the light due to the mist. Further, it is possible to reduce the liquid flowing down from the mist collector 40, and to suppress the occurrence of such a situation that the medium A, etc., is dirtied by the liquid. Furthermore, the air is exhausted or discharged from the exhaust port 43*b* to the side opposite to the fixing device 30, and moves in a direction away from the fixing device 30 at the location above the head 20. With this, it is possible to reduce any flow of the air from the mist collector 40 to a space between the head 20 and the medium A, and to prevent any deviation in the landing position of the liquid discharged or ejected from the head 20 onto the medium A. Moreover, it is possible to reduce any adhesion of the mist to the fixing device 30 which is arranged on the upstream side, in the moving direction, of the mist collector 40; and regarding the intensity of the light from the light source 31 of the fixing device 30, it is possible to suppress any lowering in the intensity of the light due to the mist.

Function and Effect

In the liquid discharging head 10, the air channel 43 has: the first part 43*d* in which the suction port 43*a* is arranged, which is located between the head 20 and the fixing device 30 in the first direction, which has one end and the other end, which extends in the second direction orthogonal to the discharge surface 20*a* and oriented from the one end toward the other end, and in which the one end is closer to the discharge surface 20*a* than the other end in the second direction; and the second part 43*e* connected to the other end of the first part 43*d*. In the second part 43*e*, the exhaust port 43*b* is not opened in the second direction, and is opened in any one of the directions which are: the direction including the direction opposite to the first direction as the directional component thereof, the third direction orthogonal to the first and second directions, and the direction opposite to the third direction.

According to this configuration, even in such a case that all the mist is not caught by the mist collector 40, the uncaught mist is not exhausted, together with the air, from the exhaust port 43*b* to the side of the fixing device 30. Accordingly, it is possible to reduce any adhesion of the mist to the fixing device 30.

In the liquid discharge apparatus 10, the exhaust port 43*b* is opened in the direction which includes the direction opposite to the first direction as the directional component thereof. According to this configuration, the exhaust pot 43*b* is opened in the direction away from the fixing device 30. The mist, which has not been caught by the mist collector 40 and remains is exhausted from the exhaust port 43*b* together with the air, in the direction away from the fixing device 30. Accordingly, it is possible to reduce any adhesion of the mist to the fixing device 30.

In the liquid discharge apparatus 10, the fixing device 30 has the generating source configured to generate the energy, the case 35 configured to accommodate the generating source, and the inlet port 35*a* configured to make the air to flow from outside to inside of the case 35 therethrough. The inlet port 35*a* is arranged in the fixing device 30, at the range thereof which is different from a location on the side of the head 20. According to this configuration, it is possible to reduce the occurrence of such a situation that the mist of the liquid discharged or ejected from the head 20 flows into the fixing device 30 via the inflow port 35*a*, and adheres to the generating sources 31.

In the liquid discharge apparatus 10, the fixing device 30 has the second fan 36 configured to rotate about the second rotational shaft 36*b* so as to allow the air to flow from the outside to the inside of the case 35 via the inlet port 35*a*. The mist collector 40 has the first fan 41 configured to rotate about the first rotational shaft 41*b* so as to exhaust, from the exhaust port 43*b*, the air sucked via the suction port 43*a*. The first fan 41 and the second fan 36 are arranged so that the extending direction 41*b*1 in which the first rotational shaft 41 extends and the extending direction 36*b*1 in which the second rotational shaft 36 extends are not parallel to each other.

According to this configuration, the air exhausted by the first fan 41 via the exhaust port 43*b* flows in the direction away from the outflow port 35*a*. Accordingly, it is possible to reduce occurrence of such a situation that the mist included in the air flows into the fixing device 30 via the inflow port 35*a* and adheres to the generating sources 31.

In the liquid discharge apparatus 10, at least the part of the exhaust port 43*b* is located, in the second direction, away from the discharge surface 20*a* than the inlet port 35*a*. According to this configuration, since the upper end of the exhaust port 43*b* is located above the inflow port 35*a*, the air channel 43 of the mist collector 40 is arranged between the exhaust port 43*b* and the inflow port 35*a*. This air channel 43 suppresses any movement of the mist from the exhaust port 43*b* to the inflow port 35*a*. Accordingly, it is possible to reduce the mist flowing from the exhaust port 43*b* into the inflow port 35*a*, and to reduce such a situation that the mist flows into the fixing device 30 via the inflow port 35*a* and adheres to the generating sources 31.

The liquid discharge apparatus 10 is provided with: the casing 11 accommodating the head 20, the fixing device 30 and the mist collector 40 therein, and having the lid 14 which is openable/closable at the upper part of the casing 11. The mist collector 40 has: the filter 48 which covers the exhaust port 43*b*, and the holder 49 which is configured to hold the filter 48 and configured to be detachable and attachable in the up-down direction.

According to this configuration, in the casing 11, the lid 14 is lifted with respect to the main body 13 so as to open the upper opening 13*a* of the main body 13. Since the upper opening 13*a* faces the opening part 45*a*, the user moves the holder 49 in the up-down direction via the upper opening 13*a* and the opening part 45*a*, thereby making it possible to easily detach/attach the holder 49 with respect to the mist collector 40. Further, by attaching the holder 49 to the mist collector 40, it is possible to reduce the mist exhausted from the exhaust port 43*b*, with the filter 48 held by the holder 49, and to reduce any adhesion of the mist to the fixing device 30. Furthermore, by detaching the holder 49 from the mist collector 40, it is possible to exchange the filter 48 held by the holder 49, and to suppress the occurrence of such a situation that the filer 48 is filled with the liquid and that the liquid leaks from the filter 48.

The liquid discharge apparatus 10 is provided with the conveying device 60 configured to convey the medium A. The suction port 43*a* is positioned to be opposable to the medium A which is being conveyed by the conveying device 60. According to this configuration, the mist collector 40 is capable of collecting the mist from the suction port 43*a* before the mist from the head 20 adhered to the medium A, and of reducing the mist adhered to the medium A.

In the liquid discharging head 10, the filter surface 48*a* faces the facing surface 45*f*, and has the right lower end 48*d* close to the suction port 43*a* in the second direction and the right upper end 48*e* far from the suction port 43*a* in the second direction. Hereinafter, the right lower end 48*d* is referred to as the first end 48*d*, and the right upper end 48*e* is referred to as the second end 48*e*. In the first direction, the second end 48*e* is closer to the facing surface 45*f* than the first end 48*d*.

According to this configuration, the spacing distance between the filter surface 48*a* and the facing surface 45*f* is made to be narrower on the side of the second end 48*e*, than on the side of the first end 48*d*. Accordingly, a space in which the convection is generated in the spacing distance is reduced, and the convection is less likely to occur. With this, the mist included in the convection is reduced, thereby making it possible to reduce the liquid adhered to the facing surface 45*f* due to the convection and flowing down from the mist collector 40.

Further, in the corner part 45, the filter surface 48*a* is inclined so that the filter surface 48*a* approaches toward the facing surface 45*f* from the first end 48*d* toward the second end 48*e*, and faces the side of the suction port 43*a* in the up-down direction. Accordingly, the air flows from the suction port 43*a* toward the filter surface 48*a*, and flows into the filter 48. The filter surface 48*a* into which the air flows is great, and thus the mist included in the air is caught and collected by the filter 48 efficiently. With this, the mist included in the convection is reduced, thereby making it possible to reduce the adhesion of the liquid to the facing surface 48*f* due to the convection and flowing down of the liquid from the mist collector 40.

Further, the spacing distance between the first end 48*d* and the facing surface 45*f* is greater than the spacing distance between the second end 48*e* and the facing surface 45*f*. Accordingly, in the filter 48, even in a case that the caught liquid remains at the side of the first end 48*d*, the air inflowed from the suction port 43*a* passes through the spacing distance between the first end 48*d* and the facing surface 48*f*, and is allowed to flow into the corner part 45. Accordingly, in the corner part 45, the mist included in the air can be caught and collected at the side of the second end 48*e* of the filter 48.

In the liquid discharge apparatus 10, the filter 48 has a shape which is rectangular parallelepiped. In a case that the filter 48 holds or retains the caught mist, the caught mist moves to a lower part of the filter 48 due to the gravity. In a case that a holding amount of the mist per a unit volume of the filter exceeds a threshold value, the air is less likely to flow. Accordingly, there is such a case that a part of the filter 48 is less likely to allow the air to flow therethrough. For example, in a filter 48 having a triangular shape as seen from the front side, and having a corner which is oriented downward, a lower part of the filter 48 has a volume smaller than that of an upper part thereof, and the lower part is less likely to allow the air to flow therethrough at the holding amount of the mist which is smaller than a filter 48 having a rectangular parallelepiped shape.

In contrast, in a case that the filter 48 has a rectangular parallelepiped shape, the volume of the upper part, of the filter 48, which is on the upper side from a central part thereof in the up-down direction and the volume of the lower part, of the filter 48, which is on the lower side from the central part are equal to each other. Accordingly, in the filter 48 having the rectangular parallelepiped shape, it is less likely that the lower part of the filter 48 hardly allows the air to flow therethrough, as compared with the filter 48 having the triangular shape as seen from the front side, and having the corner which is oriented downward. Further, since the filter 48 has the volume, of the lower part, which is greater as compared with another filter 48 having the triangular shape as seen from the front side, and having the corner which is oriented downward, the filter 48 is capable of sufficiently holding the caught mist, and to reduce the liquid flowing down from the mist collector, to an extent corresponding to the great volume of the lower part hereof.

In the liquid discharge apparatus 10, the first end 48*d* of the filter 48 is arranged at the horizontal part 46. According to this configuration, the filter 48 is capable of securing, at the corner part 45, a passage of the air current along the first direction. Further, the liquid caught by the filter 48 remains at the second part 46, thereby making it possible to reduce the liquid flowing down from the mist collector 40.

In the liquid discharge apparatus 10, the second direction is parallel to a direction from the lower side toward the upper side, and the liquid discharge apparatus 10 is provided with the holder 49 holding the filter 48. The holder 49 covers the lower part of the filter 48. According to this configuration, the holder 49 is capable of protecting the filter 48. Further, the holder 49 is capable of preventing the liquid, caught by the filter 48, from leaking from the filter 48, and of reducing the liquid flowing down from the mist collector 40.

In the liquid discharge apparatus 10, the air channel 43 has the opening part 45*a* via which the holder 49 is allowed to pass, and the guide 43*c* provided on the inner surface of the air channel 43 and guiding the holder 49 which has passed through the opening part 45*a*. According to this configuration, by detaching and attaching the holder 49 with respect to the air channel 43 via the opening part 45*a*, it is possible to exchange the filter 48 held by the holder 49, and to suppress the occurrence of such a situation that the filer 48 is filled with the liquid caught and collected by the filter 48 and that the liquid leaks from the filter 48.

In the liquid discharge apparatus 10, the filter 48 has the side surface 48*c* extending along the circumferential edge of the filter surface 48*a*. The holder 49 has the covering part 49*d* covering the side surface 48*c* on the side of the second end 48*e* and the opening part 45*a*, and the handle part 49 projecting from the covering part 49*d*. The gap is defined between the second end 48*e* and the circumferential edge part of the opening part 45*a*.

According to this configuration, in a case that the covering part 49*d* is overlaid on the circumferential edge part of the opening part 45*a* and covers the opening part 45*a*, the gap is defined between the second end 48*e* and the circumferential edge part of the opening part 45*a*. Accordingly, it is possible to prevent the second end 48*e* of the filter 48 from being caught between the covering part 49 and the circumferential edge part.

In the liquid discharge apparatus 10, the first part 44 has the expanded diameter part 44*f*. The expanded diameter part 44 has the first inner wall 44*b*1 which extends in the second direction from the suction port 43*a*, and the second inner wall 44*a*1 which is closer to the head 20 than the first inner wall 44*b*1. The second inner wall 44*a*1 extends so that the second inner wall 44*a*1 approaches closer to the head 20 toward the suction port 43*a* in the direction opposite to the second direction.

According to this configuration, the suction port 43*a* is expanded toward the head 20 by the expanded diameter part 44*f*. Accordingly, it is possible to shorten the spacing distance between the head 20 and the mist collector 40, to reduce the spread of the mist in this spacing distance, and to allow the mist collector 40 to suck the mist efficiently via the suction port 43*a*.

Further, in the expanded diameter part 44*f*, the second inner wall 44*a*1 is inclined with respect to the first inner wall 44*b*1. Accordingly, the air inflowed from the suction port 43*a* changes the direction of the flow thereof gradually along the second inner wall 44*a*1. With this, the generation of any reverse flow is reduced, thereby allowing the air to flow smoothly in the vertical part 44, and thus allowing the mist collector 40 to suck the mist efficiently.

The liquid discharge apparatus 10 is provided with the carriage 52 having the head 20 mounted thereon and configured to reciprocally move in the first direction and in the direction opposite to the first direction, and the connecting part 56 connecting the head 20 and the carriage 52. The second direction is the up direction. The second inner wall 44*a*1 of the expanded diameter part 44*f* is arranged at the location below the connecting part 56. According to this configuration, it is possible to collect the mist, remaining at the location below the connecting part 56, with the mist collector 40.

The liquid discharge apparatus 10 is provided with the catching part 47 provided on the first inner wall 44*b*1 and configured to collect the liquid adhered to the first inner wall 44*b*1. According to the configuration, it is possible to receive the liquid, adhered to the first inner wall 44*b*1 and flowing down from the first inner wall 44*b*1, with the catching part 47, and to reduce the liquid flowing down from the mist collector 40.

In the liquid discharge apparatus 10, the second direction is the up direction. The catching part 47 is provided with the through hole 47*a* penetrating through the first inner wall 44*b*1, and the receiving part 47*e* which is arranged on the outer surface, of the expanded diameter part 44*f*, which is located on the side opposite to the first inner wall 44*b*1 in the first direction, at the location below the through hole 47*a*.

According to this configuration, the mist adhered to the facing surface 45*f* by the convection is liquified, and the liquid (liquified mist) flows downward along the facing surface 45*f* and the first inner wall 44*b*1. In this situation, the liquid flows through the through hole 47*a* provided on the first inner wall 44*b*1, and flows into the receiving part 47*e*. With this, it is possible to reduce the liquid flowing down from the mist collector 40.

Further, in the first right wall 44*b*, a part thereof on the side of the first inner wall 44*b*1 becomes to be a passage (channel) for the air including the mist, and the receiving part 47*e* is provided on the first right outer wall among the first right wall 44*b*. With this, it is possible to prevent the receiving part 47*e* from affecting the flow of the air.

In the liquid discharge apparatus 10, the catching part 47 is provided with the absorbing body 47*d* fitted to the receiving part 47*e* and covering the through hole 47*a*. According to this configuration, the liquid flowing down along the facing surface 45*f* and the first inner wall 44*b*1 is caught by the absorbing body 47*d*, via the through hole 47*a*. With this, it is possible to reduce the liquid flowing down from the mist collector 40.

Further, the absorbing body 47*d* is provided on the first right outer surface among the first right wall 44*b*, thereby reducing such a situation that the absorbing body 47*d* absorbs the mist before the filter 48 absorbs the mist. Accordingly, it is possible to reduce the occurrence of such a situation that the liquid in which the mist is liquified is filled in the absorbing body 47*d*, and that the liquid (liquefied mist) leaks from the absorbing body 47*d* or the receiving part 47*e*.

In the liquid discharge apparatus 10, the head 20 discharges a liquid which is cured by an energy applied thereto, as the liquid. The liquid discharge apparatus 10 is provided with the fixing device 30 which is arranged on the side opposite to the side of the head 20, with the mist collector 40 interposed therebetween, and which applies the energy to the liquid discharged onto the medium A. According to this configuration, the mist collector 40 is arranged between the head 20 and the fixing device 30, thereby making it possible to reduce the adherence of the mist from the head 20 to the fixing device 30.

First Modification

A liquid discharge apparatus 10 according to a first modification is provided with a casing 11 accommodating the head 20, the fixing device 30 and the mist collector 40 therein, in the liquid discharge apparatus 10 of the above-described embodiment, and having an intake port 13*d*2 via which an outside air is taken into the casing 11. The head 20 has a discharge surface 20*a*, and an end surface (upper end surface 20*b*) on a side opposite to the side of the discharge surface 20*a* in the second direction. The intake port 13*d*2 is arranged, in the second direction, on the side opposite to the discharge surface 20*a* with respect to the end surface (upper end surface 20*b*).

Specifically, as depicted in FIG. 2, one or a plurality of pieces of the intake port 13*ds* is/are opened in a first wall 13*d* of the casing 11, in addition to a front port 13*d*1. The front port 13*d*1 is arranged at a location below the discharge surface 20*a* of the head 20. The intake port 13*d*2 is arranged at a location above the front port 13*d*1 and on a side (upper side) opposite to the discharge surface 20*a* of the head 20 with respect to the upper end surface 20*b* of the head 20. The intake port 13*d*2 has a circumferential edge surrounding the circumference thereof crosses (for example, is orthogonal to) the discharge surface 20*a*, and crosses (for example, is orthogonal to) the front-rear direction. The plurality of pieces of the intake port 13*d*2 are arranged side by side in the left-right direction, with a spacing distance therebetween.

According to such a configuration, in a case that the first fan 41 and the second fan 36 are driven, the air flows from the outside to the inside of the casing 11 via the intake ort 13*d*2. The air flows from the intake port 13*d*2 at a location above the upper end surface 20*b* of the head 20. Accordingly, it is possible to reduce such a situation that, by the air flowing from the intake port 13*d*2, the air flows between the head 20 and the medium A. With this, it is possible to reduce such a situation that the mist is diffused and allowed to be adhered to the fixing device 30, while preventing any deviation in the landing position of the liquid discharged from the head 20 onto the medium A.

Second Modification

In a liquid discharge apparatus 10 according to a second modification, the casing 11 in the liquid discharge apparatus 10 according to the first modification has: a first wall 13*d* in which an intake port 13*d*2 is arranged, and a second wall 13*e* which is located on an opposite side to the first wall 13*d*, with the fixing device 30 and the mist collector 40 being interposed therebetween. The second wall 13*e* has a release port 13*e*2 via which the air is released to outside of the second wall 13*e*. The casing 11 is provided with a third fan 15 configured to release the air via the release port 13*e*2.

Specifically, as depicted in FIG. 2, the second wall 13*e* is arranged at a location on the rear side with respect to the first wall 13*d*, and arranged to be parallel to the first wall 13*d*. In the front-rear direction, the head 20, the fixing device 30 and the mist collector 40 are arranged between the first wall 13*d* and the second wall 13*e* in the front-rear direction. In the second wall 13*e*, the release port 13*e*2 is opened, in addition to the rear port 13*e*1. The rear port 13*e*1 is provided at a location below the discharge surface 20*a* of the head 20. The release port 13*e*2 is provided at a location above the rear port 13*e*1 and on a side (upper side) opposite to the side of the discharge surface 20*a* with respect to the upper end surface 20*b* of the head 20. In a case of viewing the front side from the rear side, the release port 13*e*2 is arranged to overlap with the intake port 13*d*2. The release port 13*e*2 has a circumferential edge surrounding the circumference of the release port 13*e*2 crosses (for example, is orthogonal to) the discharge surface 20*a*, and crosses (for example, is orthogonal to) the front-rear direction. A plurality of pieces of the release port 13*e*2 are arranged side by side in the left-right direction, with a spacing distance therebetween.

As depicted in FIG. 3, the controller 70 is connected to a third fan motor 15*a* via a third fan driving circuit 16, and controls the driving of the third fan motor 15*a*.

As depicted in FIG. 2, the third fan 15 has a third rotational shaft 15*b*, a plurality of third fins 15*c*, a third suction port 15*d* and a third blowout port 15*e*. The third rotational shaft 15*b* extends in the front-rear direction, is connected to the third fan motor 15*a* (FIG. 3), and rotates by driving of the third fan motor 15*a*. The plurality of third fins 15*c* are connected to the third rotational shaft 15*b*, and rotate about the third rotational shaft 15*b*.

The third fan 15 is arranged so that the third blowout port 15*e* is oriented to face the outside of the casing 11 and that the third suction port 15*d* is oriented to face the inside of the casing 11. The third fan 15 sucks the air inside the casing 11 from the third suction port 15*d*, and blows out the air, to the outside of the casing 11, from the third blowout port 15*e* and via the release port 13*e*2. Note that a filter covering the third suction port 15*d* may be provided.

According to such a configuration, in a case that the third fan 15 is driven, the air is released from the inside to the outside of the casing 11, via the release port 13*e*2, and the mist included in the air in the casing 11 is exhausted. With this, it is possible to prevent the mist from adhering to the medium A and to the fixing device 30. Further, since the air flows in the inside of the casing 11, from the intake port 13*d*2 at a location above the upper end surface 20*b* of the head 20, it is possible to prevent any deviation in the landing position of the liquid discharged from the head 20 onto the medium A.

Other Modifications

In the above-described embodiment, although the fixing device 30 uses the light source 31 as the generating source which generates the energy fixing the liquid to the medium A, the generating source is not limited to this. For example, it is allowable use, as the generating source, a heater which applies energy such as heat, etc. The heater is exemplified by a radiation type heater, a hot-air heater, a contact type heater, etc. For example, the contact type heater is provided on a roller. The roller heated by the contact type heater makes contact with the rear surface of the medium A, applies the energy to the liquid on the front surface of the medium A, and fixes the liquid to the medium A.

In this case, the liquid to be discharged or ejected from the head 20 is a liquid fixed (fixable) to the medium A by the energy such as heat, etc.; as the liquid, for example, a latex ink is used. Further, it is allowable that the cover 33 is not provided on the fixing device 30.

Further, it is allowable to use, as the generating source, an energy generating device which generates a radio wave such as a microwave, etc. In such a case, the liquid to be discharged or ejected from the head 20 is a liquid fixed (fixable) to the medium A by the energy such as the microwave, etc.

In the above-described embodiment, although the air channel 43 has the vertical part 44, the corner part 45 and the horizontal part 46, it is allowable that the air channel 43 has the vertical part 44 and the corner part 45, without having the horizontal part 46. In such a case, the exhaust port 43*b* is provided on a left end opening of the corner part 45 which is the second part 43*e*, is arranged on a side (left side) opposite to the side of the fixing device 30 in the left-right direction, and is opened in a direction away from the fixing device 30. Accordingly, since the mist is exhausted from the exhaust port 43*b* to the side opposite to the fixing device 30, and moves in the direction away from the fixing device 30, it is possible to reduce any adhesion of the mist to the fixing device 30.

Figure 8:
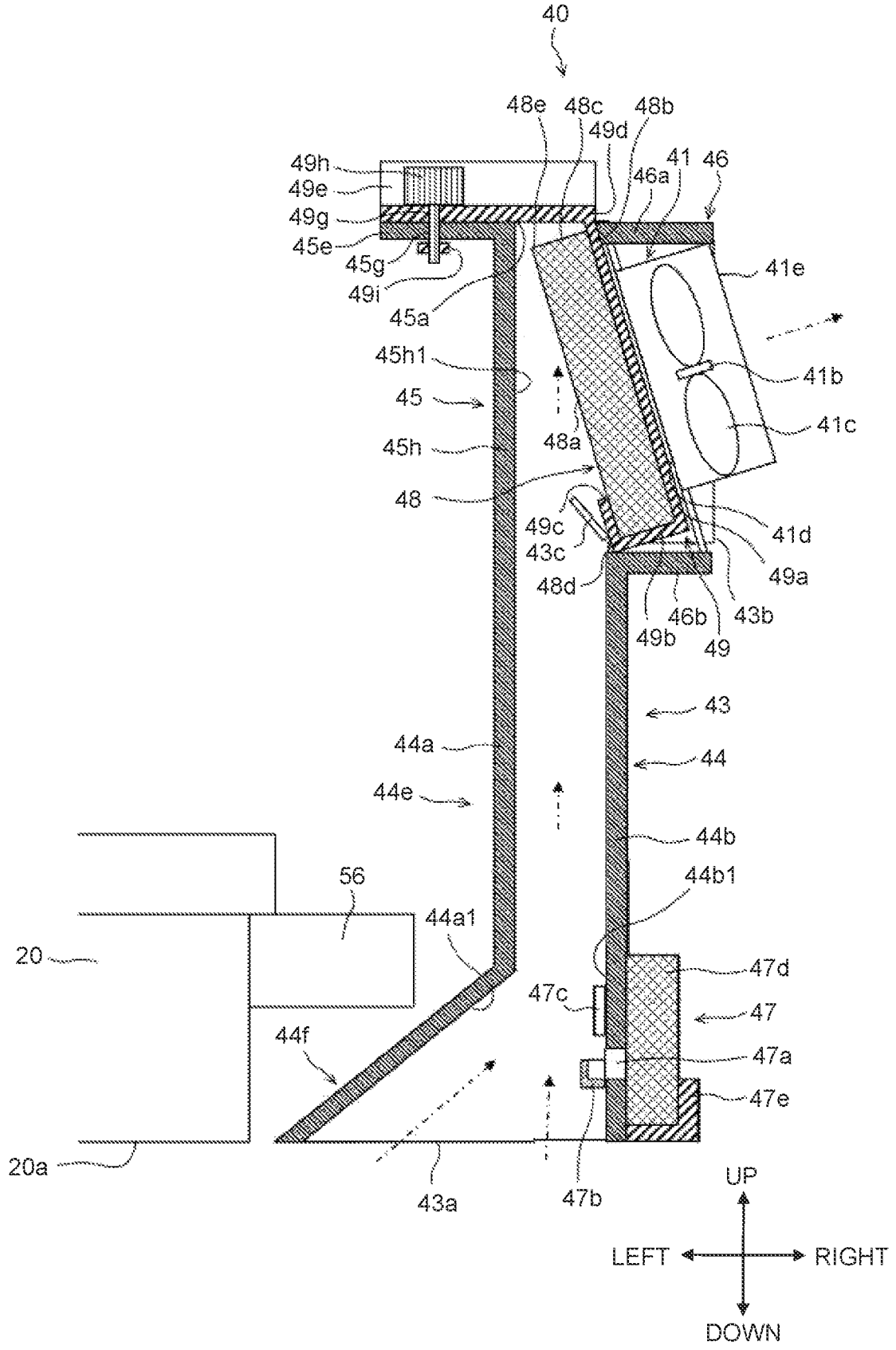
FIG. 8 is a cross-sectional view of a mist collector of a liquid discharge apparatus according to a modification of the embodiment, taken along a cross section orthogonal to the front-rear direction.

Note that in the above-described embodiment, although the horizontal part 46 extends from the corner part 45 in the left direction, the extending direction is not limited to this. The horizontal part 46 may extend in any one of directions which are: a direction including the left direction as a directional component thereof, the front direction, and the rear direction. It is allowable that the horizontal part 46 extends from the corner part 45 rightward, as depicted in FIG. 8. In such a case, the corner part 45 has a third left wall 45*h*, rather than the third right wall 45*b*. The inner surface of the third left wall 45*h* is a facing surface 45*h*1 which faces the filter surface 48*a* in the left-right direction. The facing surface 45*h*1 has a lower end connected to an upper end of the second inner wall 44*a*1, and the facing surface 45*h*1 is arranged on a same plane as the second inner wall 44*a*1.

In the above-described embodiment, the filter 48 has the shape of the rectangular parallelepiped. Note that, however, under a condition that the second end 48*e* of the filter 48 is closer to the facing surface 45*f* than the first end 48*d* in the second direction, the shape of the filter 48 is not limited to this. For example, the filter 48 may have a shape of a triangular prism. In such a case, the filter 48 has a cross sectional shape of a triangle of which size in the left-right direction becomes smaller toward a lower part thereof, and which is orthogonal to the front-rear direction, and the filter 48 extends in the front-rear direction.

In the above-described embodiment, although the catching part 47 is provided on the first left wall 44, the location at which the catching part 47 is arranged is not limited to this. The catching part 47 may be provided on a wall including, for example: the first right wall 44*b*, the first front wall 44*c* and the first rear wall 44*d*, etc. In such a case, the through hole 47*a* of the catching part 47 penetrates through the wall of the vertical part 44, and the absorbing body 47 and the receiving part 47*e* are provided on the outer wall of the wall, and the guiding plate 47*b* and the projected parts 47*c* are provided on the inner surface of the wall. With this, it is possible to reduce the liquid flowing down from the mist collector 40.

Further note that all the above-described embodiment and modifications may be combined, unless mutually exclusive with one another. Further, from the above-described explanation, numerous improvements and/or other embodiments of the present disclosure will be apparent to those skilled in the art. Accordingly, the foregoing explanation should be interpreted as a mere example, and as being provided for the purpose of providing, to those skilled in the art, the best mode for carrying out the present disclosure. The configuration and/or the detailed function of the present disclosure may be substantially changed, without departing from the spirit of the present disclosure.

The liquid discharge apparatus and the head unit of the present disclosure are useful as, for example, a liquid discharge apparatus and a head unit, etc., which are capable of reducing the adhesion of the mist to the fixing device. The liquid discharge apparatus and the mist collector of the present disclosure are useful as, for example, a liquid discharge apparatus and a mist collector, etc., which are capable of reducing a liquid flowing down from the mist collector.

What is claimed is:

1. A liquid discharge apparatus comprising:

a head including a discharge surface in which a nozzle for discharging a liquid toward a medium is opened;

a fixing device configured to fix the liquid on the medium; and a mist collector configured to collect a mist of the liquid, the mist collector and the fixing device being arranged side by side in this order in a first direction parallel to the discharge surface, wherein the mist collector includes an air channel including a suction port via which air is sucked into the mist collector, and an exhaust port via which the air is exhausted from the mist collector, wherein the air channel includes:

a first part in which the suction port is arranged, which is located between the head and the fixing device in the first direction, which includes one end and the other end, which extends in a second direction orthogonal to the discharge surface and oriented from the one end toward the other end, and in which the one end is closer to the discharge surface than the other end in the second direction; and a second part connected to the other end of the first part;

wherein the exhaust port is opened, in the second part, toward any one of a plurality of directions which are: a direction including a direction opposite to the first direction as a directional component thereof, a third direction orthogonal to both the first direction and the second direction, and a direction opposite to the third direction, wherein the fixing device includes a fan configured to allow the air to flow from outside of the fixing device to inside of the fixing device, and wherein the mist collector includes another fan configured to exhaust, from the exhaust port, the air sucked via the suction port.

2. The liquid discharge apparatus according to claim 1, wherein the exhaust port is opened toward the direction including the direction opposite to the first direction as the directional component thereof.

3. The liquid discharge apparatus according to claim 1, wherein the fixing device includes: a generating source configured to generate an energy, a case accommodating the generating source, and an inlet port via which the air is allowed to flow from outside of the case to inside of the case therethrough; and wherein the inlet port is arranged in an area, of the fixing device, which does not overlap with the head in both the first direction and the second direction.

4. The liquid discharge apparatus according to claim 3, wherein a rotational shaft of the fan and the rotational shaft of the another fan are not parallel to each other.

5. The liquid discharge apparatus according to claim 3, wherein at least a part of the exhaust port is located, in the second direction, farther away from the discharge surface than the inlet port.

6. The liquid discharge apparatus according to claim 1, further comprising a casing accommodating the head, the fixing device and the mist collector therein, and including a lid which is openable/closable at an upper part of the casing; and wherein the mist collector includes: a filter covering the exhaust port, and a holder holding the filter and configured to be detachable and attachable in an up-down direction.

7. The liquid discharge apparatus according to claim 1, further comprising a casing accommodating the head, the fixing device and the mist collector therein, and including an intake port via which an outside air is taken into the casing, and wherein the head includes the discharge surface, and an end surface on a side opposite to the discharge surface in the second direction, and wherein the intake port is located farther away from the discharge surface than the end surface in the second direction.

8. The liquid discharge apparatus according to claim 7, wherein the casing includes a first wall in which the intake port is arranged, and a second wall located on an opposite side to the first wall, with the head, the fixing device and the mist collector being interposed therebetween, wherein the second wall includes a release port configured to allow the air to be released to outside of the casing, and wherein the casing includes a fan configured to release the air via the release port.

9. The liquid discharge apparatus according to claim 1, further comprising a conveyor configured to convey the medium, wherein the suction port is positioned to be opposable to the medium conveyed by the conveyor.

10. The liquid discharge apparatus according to claim 1, wherein the liquid is cured in a case that an energy is applied to the liquid, and wherein the fixing device is configured to apply the energy to the liquid on the medium.

11. The liquid discharge apparatus according to claim 1, wherein the mist collector includes a filter arranged inside the air channel and including a filter surface, wherein the air channel includes a corner part arranged between the suction port and the exhaust port, a vertical part extending from the suction port to the corner part in the second direction, and a horizontal part extending from the corner part to the exhaust port in the first direction, wherein the corner part includes a facing surface crossing the first direction, and wherein the filter surface faces the facing surface, includes a first end which is close to the suction port in the second direction and a second end which is far from the suction port in the second direction, the second end being closer to the facing surface than the first end in the first direction.

12. The liquid discharge apparatus according to claim 11, wherein the filter has a shape of a rectangular parallelepiped.

13. The liquid discharge apparatus according to claim 11, wherein the first end of the filter is arranged in the second part.

14. The liquid discharge apparatus according to claim 11, further comprising a carriage which has the head mounted thereon and which is configured to move in the first direction and a direction opposite to the first direction in a reciprocating manner, wherein in a case that the carriage moves in the first direction, the head discharges the liquid onto the medium.

15. The liquid discharge apparatus according to claim 11, further comprising a holder configured to hold the filter, wherein the second direction is a direction from a lower side to an upper side, and the holder covers a lower part of the filter.

16. The liquid discharge apparatus according to claim 15, wherein the air channel detachably receives the holder, and wherein the air channel includes an opening through which the holder is passed when the holder is attached or detached the air channel, and a guide provided on an inner surface of the air channel and configured to guide the holder which has passed through the opening when the holder is attached to or detached from the air channel.

17. The liquid discharge apparatus according to claim 16, wherein the filter includes a lateral surface extending along a circumferential edge of the filter surface;

wherein the holder includes: a covering part covering the opening and the lateral surface on the side of the second end, and a handle part protruding from the covering par, and wherein a gap is defined between the second end and the circumferential edge of the opening.

18. The liquid discharge apparatus according to claim 11, wherein the first part includes an expanded part, wherein the expanded part includes a first inner wall extending from the suction port in the second direction, and a second inner wall which is closer to the head than the first inner wall, and wherein the second inner wall extends toward the suction port in a direction opposite to the second direction such that the second inner wall approaches closer to the head.

19. A head unit comprising:

a head including a discharge surface, a nozzle via which a liquid is discharged toward a medium being formed in the discharge surface;

a fixing device configured to fix the liquid on the medium; and a mist collector configured to collect a mist of the liquid, the mist collector and the fixing device being arranged side by side in this order in a first direction parallel to the discharge surface, wherein the mist collector includes an air channel including a suction port via which air is sucked into the mist collector, and an exhaust port via which the air is exhausted from the mist collector;

the air channel includes:

a first part in which the suction port is arranged, which is located between the head and the fixing device in the first direction, which includes one end and the other end, which extends in a second direction orthogonal to the discharge surface and oriented from the one end toward the other end, and in which the one end is closer to the discharge surface than the other end in the second direction, and a second part connected to the other end of the first part; and wherein the exhaust port is opened, in the second part, in any one of a plurality of directions which are: a direction including a direction opposite to the first direction as a directional component thereof, a third direction orthogonal to both the first direction and the second direction, and a direction opposite to the third direction, wherein the fixing device includes a fan configured to allow the air to flow from outside of the fixing device to inside of the fixing device, and wherein the mist collector includes another fan configured to exhaust, from the exhaust port, the air sucked via the suction port.

20. A mist collector comprising:

an air channel configured to allow an air to flow therethrough; and a filter arranged inside the air channel and having a filter surface, wherein the air channel includes a suction port via which the air is sucked into the air channel, an exhaust port via which the air is exhausted from the air channel, a corner part arranged between the suction port and the exhaust port, a horizontal part extending from the corner part to the exhaust port in a first direction, and a vertical part extending from the suction port to the corner part in a second direction crossing the first direction;

wherein the corner part includes a facing surface crossing the first direction, and wherein the filter surface faces the facing surface, includes a first end which is close to the suction port in the second direction and a second end which is far from the suction port in the second direction, the second end being closer to the facing surface than the first end in the first direction.

* * * * *